US010023424B2

(12) United States Patent
Awano

(10) Patent No.: US 10,023,424 B2
(45) Date of Patent: Jul. 17, 2018

(54) SHEET PROCESSING APPARATUS AND IMAGE FORMING SYSTEM

(71) Applicant: FUJI XEROX CO., LTD., Tokyo (JP)

(72) Inventor: Hiroaki Awano, Yokohama (JP)

(73) Assignee: FUJI XEROX CO., LTD., Tokyo (JP)

( * ) Notice: Subject to any disclaimer, the term of this patent is extended or adjusted under 35 U.S.C. 154(b) by 78 days.

(21) Appl. No.: 15/207,972

(22) Filed: Jul. 12, 2016

(65) Prior Publication Data

US 2017/0090391 A1 Mar. 30, 2017

(30) Foreign Application Priority Data

Sep. 24, 2015 (JP) ..... 2015-187167
Mar. 24, 2016 (JP) ..... 2016-060834

(51) Int. Cl.

| | |
|---|---|
| ***B65H 45/20*** | (2006.01) |
| ***B65H 45/10*** | (2006.01) |
| ***B65H 29/70*** | (2006.01) |
| ***B65H 45/101*** | (2006.01) |
| ***B65H 37/06*** | (2006.01) |
| ***G03G 15/00*** | (2006.01) |

(52) U.S. Cl.
CPC ..... *B65H 45/20* (2013.01); *B65H 29/70* (2013.01); *B65H 37/06* (2013.01); *B65H 45/10* (2013.01); *B65H 45/101* (2013.01); *G03G 15/6582* (2013.01); *G03G 2215/00877* (2013.01); *G03G 2215/0132* (2013.01)

(58) Field of Classification Search
CPC ..... B65H 29/70; B65H 37/06; B65H 45/10; B65H 45/20; B65H 45/101
USPC ..... 270/39.01; 271/188; 193/430, 433, 435, 193/448, 451, 459, 460
See application file for complete search history.

(56) References Cited

U.S. PATENT DOCUMENTS

| | | | | |
|---|---|---|---|---|
| 6,436,024 | B1 | 8/2002 | Kobayashi | |
| 7,569,011 | B2 | 8/2009 | Matsumoto | |
| 7,712,732 | B2 * | 5/2010 | Horii | B65H 29/60 270/32 |
| 7,946,565 | B2 * | 5/2011 | Kubota | B42C 9/0037 270/21.1 |
| 8,771,159 | B2 * | 7/2014 | Imazu | B65H 45/145 270/20.1 |

(Continued)

FOREIGN PATENT DOCUMENTS

| | | |
|---|---|---|
| EP | 2 921 444 A1 | 9/2015 |
| JP | 2945541 B2 | 9/1999 |

(Continued)

OTHER PUBLICATIONS

Communication issued by the State Intellectual Property Office of P.R. China dated Oct. 9, 2017, in counterpart Chinese Patent Application No. 201610671121.8.

*Primary Examiner* — Leslie A Nicholson, III
(74) *Attorney, Agent, or Firm* — Sughrue Mion, PLLC

(57) ABSTRACT

A sheet processing apparatus includes: an output unit that renders one side of a sheet convex and outputs the sheet, the sheet having the one side and other side; a first folding unit that mountain-folds the one side of the sheet, which is rendered to be convex, to form a first fold in the sheet; and a second folding unit that mountain-folds the one side of the sheet, which includes the first fold formed therein, to form a second fold in the sheet.

4 Claims, 21 Drawing Sheets

(56) References Cited

U.S. PATENT DOCUMENTS

| | | | | |
|---|---|---|---|---|
| 8,814,772 | B2 * | 8/2014 | Mimura | B65H 45/142 493/416 |
| 9,311,578 | B2 * | 4/2016 | Takahashi | G03G 15/6538 |
| 9,334,140 | B2 * | 5/2016 | Watanabe | B65H 45/04 |
| 9,459,574 | B1 * | 10/2016 | Sunohara | G03G 15/2085 |
| 2004/0185993 | A1 | 9/2004 | Doi | |
| 2007/0135288 | A1 | 6/2007 | Matsumoto | |
| 2010/0304947 | A1 | 12/2010 | Itou | |
| 2011/0101593 | A1 | 5/2011 | Imazu et al. | |
| 2014/0336030 | A1 | 11/2014 | Tobishima | |
| 2015/0183611 | A1 * | 7/2015 | Awano | B65H 29/125 493/411 |

FOREIGN PATENT DOCUMENTS

| | | | |
|---|---|---|---|
| JP | 2004-284742 | A | 10/2004 |
| JP | 3674224 | B2 | 7/2005 |
| JP | 4175642 | B2 | 11/2008 |
| JP | 4654900 | B2 | 3/2011 |
| JP | 2011-93686 | A | 5/2011 |
| JP | 2012-121704 | A | 6/2012 |

* cited by examiner

OUTER IMAGE C-FOLDING
(ENVELOPE C-FOLDING)

INNER IMAGE C-FOLDING
(ENVELOPE C-FOLDING)

REGULAR OUTPUT MODE

REVERSED OUTPUT MODE

FIG. 12

| FOLDING MODE | IMAGE OUTPUT MODE | SETTING FOR DECURLER |
|---|---|---|
| NO | REGULAR OUTPUT | MAINTAIN CURL DIRECTION (CONVEX UPWARD) |
| ENVELOPE Z-FOLDING | REGULAR OUTPUT | MAINTAIN CURL DIRECTION (CONVEX UPWARD) |
| OUTER IMAGE C-FOLDING (ENVELOPE C-FOLDING) | REGULAR OUTPUT | CHANGE CURL DIRECTION (CONVEX DOWNWARD) |
| INNER IMAGE C-FOLDING (ENVELOPE C-FOLDING) | REVERSED OUTPUT | CHANGE CURL DIRECTION (CONVEX DOWNWARD) |
| Z-FOLDING | REGULAR OUTPUT | MAINTAIN CURL DIRECTION (CONVEX UPWARD) |

AT INTAKE

AFTER FIRST FOLD IS FORMED

AFTER SECOND FOLD IS FORMED

AT INTAKE

AFTER FIRST FOLD IS FORMED

AFTER SECOND FOLD IS FORMED

AT INTAKE

AFTER FIRST FOLD IS FORMED

AFTER SECOND FOLD IS FORMED

AT INTAKE

AFTER FIRST FOLD IS FORMED

AFTER SECOND FOLD IS FORMED

ENVELOPE C-FOLDING OF PAPER THAT IS "CONVEX DOWNWARD"

ENVELOPE C-FOLDING OF PAPER THAT IS "CONVEX UPWARD"

FIG. 19

| FOLDING MODE | IMAGE OUTPUT MODE | SETTING FOR INVERTER |
|---|---|---|
| NO | REGULAR OUTPUT | NOT USED |
| ENVELOPE Z-FOLDING | REGULAR OUTPUT | NOT USED |
| OUTER IMAGE C-FOLDING (ENVELOPE C-FOLDING) | REVERSED OUTPUT | USED |
| INNER IMAGE C-FOLDING (ENVELOPE C-FOLDING) | REGULAR OUTPUT | USED |
| Z-FOLDING | REGULAR OUTPUT | NOT USED |

FIG. 20

| FOLDING MODE | IMAGE FORMED SIDE | WHEN BROUGHT INTO TRANSPORT UNIT | | WHEN BROUGHT INTO FOLDING UNIT | | FIRST FOLDING | | SECOND FOLDING | |
|---|---|---|---|---|---|---|---|---|---|
| | | LOWER SIDE | CONVEX SIDE | LOWER SIDE | CONVEX SIDE | FIRST FOLD FORMED SIDE (MOUNTAIN FOLD) | FIRST FOLD FORMED POSITION | SECOND FOLD FORMED SIDE (MOUNTAIN FOLD) | SECOND FOLD FORMED POSITION |
| ENVELOPE Z-FOLDING | FRONT SIDE Pa | FRONT SIDE Pa | REAR SIDE Pb | FRONT SIDE Pa | REAR SIDE Pb | FRONT SIDE Pa | LEADING EDGE SIDE | REAR SIDE Pb | TRAILING EDGE SIDE |
| OUTER IMAGE C-FOLDING | FRONT SIDE Pa | FRONT SIDE Pa | REAR SIDE Pb | FRONT SIDE Pa | FRONT SIDE Pa | FRONT SIDE Pa | TRAILING EDGE SIDE | FRONT SIDE Pa | LEADING EDGE SIDE |
| INNER IMAGE C-FOLDING | FRONT SIDE Pa | REAR SIDE Pb | FRONT SIDE Pa | REAR SIDE Pb | REAR SIDE Pb | REAR SIDE Pb | TRAILING EDGE SIDE | REAR SIDE Pb | LEADING EDGE SIDE |
| Z-FOLDING | FRONT SIDE Pa | FRONT SIDE Pa | FRONT SIDE Pa | FRONT SIDE Pa | REAR SIDE Pb | FRONT SIDE Pa | LEADING EDGE SIDE | REAR SIDE Pb | TRAILING EDGE SIDE |

FIG. 21

| FOLDING MODE | IMAGE FORMED SIDE | WHEN BROUGHT INTO TRANSPORT UNIT | | WHEN BROUGHT INTO FOLDING UNIT | | FIRST FOLDING | | SECOND FOLDING | |
|---|---|---|---|---|---|---|---|---|---|
| | | LOWER SIDE | CONVEX SIDE | LOWER SIDE | CONVEX SIDE | FIRST FOLD FORMED SIDE (MOUNTAIN FOLD) | FIRST FOLD FORMED POSITION | SECOND FOLD FORMED SIDE (MOUNTAIN FOLD) | SECOND FOLD FORMED POSITION |
| ENVELOPE Z-FOLDING | FRONT SIDE Pa | FRONT SIDE Pa | REAR SIDE Pb | FRONT SIDE Pa | REAR SIDE Pb | FRONT SIDE Pa | LEADING EDGE SIDE | REAR SIDE Pb | TRAILING EDGE SIDE |
| OUTER IMAGE C-FOLDING | FRONT SIDE Pa | REAR SIDE Pb | FRONT SIDE Pa | FRONT SIDE Pa | FRONT SIDE Pa | FRONT SIDE Pa | TRAILING EDGE SIDE | FRONT SIDE Pa | LEADING EDGE SIDE |
| INNER IMAGE C-FOLDING | FRONT SIDE Pa | FRONT SIDE Pa | REAR SIDE Pb | REAR SIDE Pb | REAR SIDE Pb | REAR SIDE Pb | TRAILING EDGE SIDE | REAR SIDE Pb | LEADING EDGE SIDE |
| Z-FOLDING | FRONT SIDE Pa | FRONT SIDE Pa | REAR SIDE Pb | FRONT SIDE Pa | REAR SIDE Pb | FRONT SIDE Pa | LEADING EDGE SIDE | REAR SIDE Pb | TRAILING EDGE SIDE |

SHEET PROCESSING APPARATUS AND IMAGE FORMING SYSTEM

CROSS-REFERENCE TO RELATED APPLICATIONS

This application is based on and claims priority under 35 USC 119 from Japanese Patent Application No. 2015-187167 filed on Sep. 24, 2015 and Japanese Patent Application No. 2016-060834 filed on Mar. 24, 2016.

BACKGROUND

Technical Field

The present invention relates to a sheet processing apparatus and an image forming system.

SUMMARY

The present invention reduces folding defects in a sheet subjected to inner tri-folding.

According to an aspect of the invention, there is provided a sheet processing apparatus comprising: an output unit that renders one side of a sheet convex and outputs the sheet, the sheet having the one side and other side; a first folding unit that mountain-folds the one side of the sheet, which is rendered to be convex, to form a first fold in the sheet; and a second folding unit that mountain-folds the one side of the sheet, which includes the first fold formed therein, to form a second fold in the sheet.

BRIEF DESCRIPTION OF THE DRAWINGS

FIG. 12 is a diagram illustrating a relationship among a folding mode, an image output mode, and a setting for a decurler in the first exemplary embodiment;

FIG. 19 is a diagram illustrating a relationship among a folding mode, an image output mode, and a setting for an inverter in the second exemplary embodiment;

FIG. 20 is a diagram illustrating a relationship between the folding mode and the state of a paper in the first exemplary embodiment; and FIG. 21 is a diagram illustrating a relationship between the folding mode and the state of a paper in the second exemplary embodiment.

DETAILED DESCRIPTION

Hereinafter, exemplary embodiments of the present invention will be described in detail with reference to the appended drawings.

First Exemplary Embodiment

Configuration of Image Forming System

Figure 1:
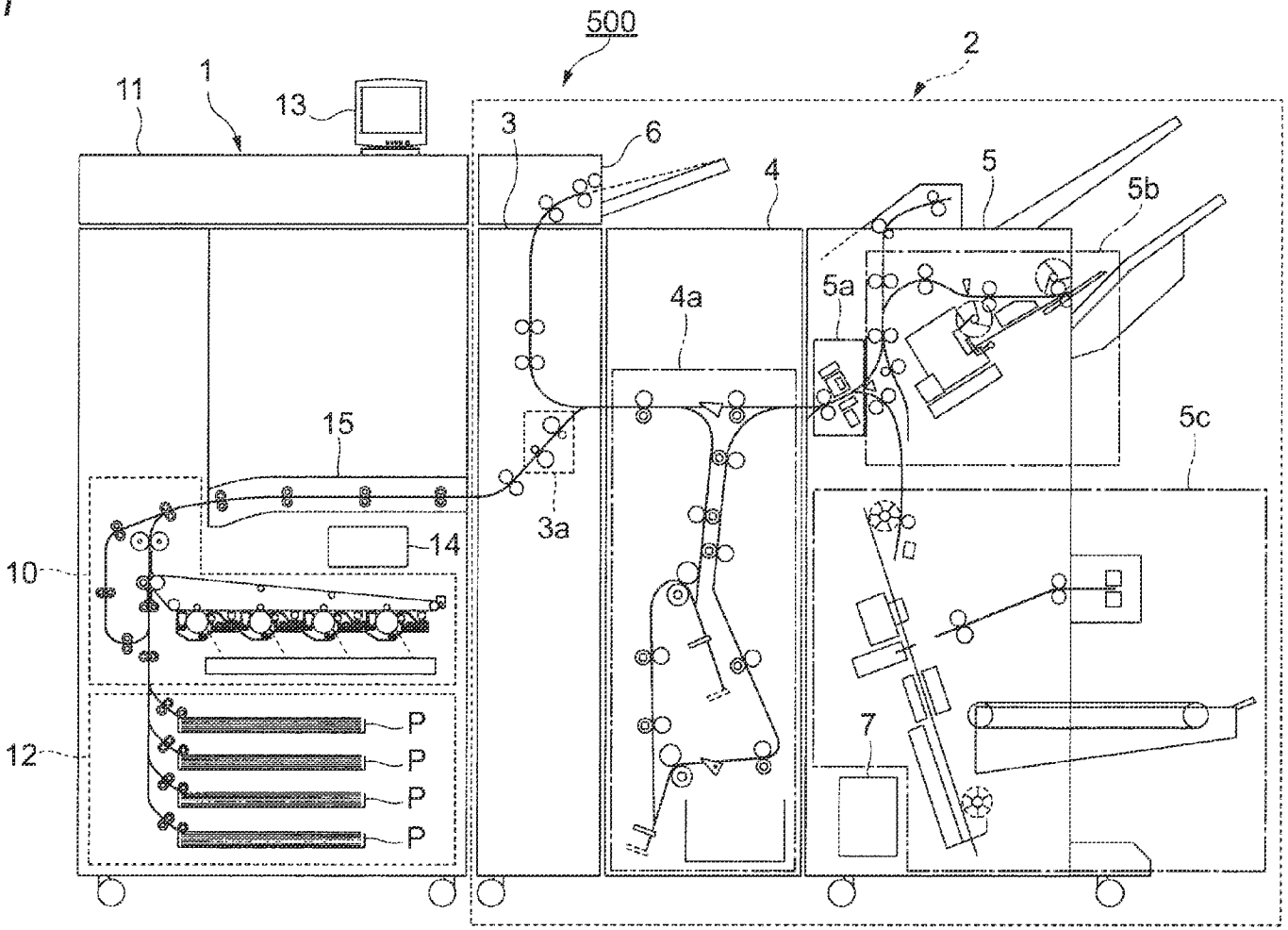
FIG. 1 is a diagram illustrating an overall configuration of an image forming system to which a first exemplary embodiment is applied.

FIG. 1 is a diagram illustrating an overall configuration of an image forming system 500 to which the present exemplary embodiment is applied.

The image forming system 500 includes an image forming apparatus 1 that forms an image on a paper P, and a post-processing apparatus 2 that performs post-processing of the paper P on which an image is formed by the image forming apparatus 1.

First, the image forming apparatus 1 includes an image forming unit 10 that forms an image on the basis of image data, an image reading unit 11 that reads an image from an original document to generate read image data, a paper supply unit 12 that supplies the paper P, one example of a sheet, to the image forming unit 10, a user interface unit 13 that receives operations by a user and presents information to the user, and a main controller 14 that controls operation of the entirety of the image forming system 500. The image forming apparatus 1 further includes a paper relaying unit 15 that relays the paper P output from the image forming unit 10 after image formation to the post-processing apparatus 2.

The post-processing apparatus 2, one example of a sheet processing apparatus, includes a transport unit 3 that receives the paper P after image formation from the image forming apparatus 1 and transports the paper P, a folding unit 4 that performs, if necessary, folding of the paper P brought in from the transport unit 3, and a post-processing unit 5 that performs another type of post-processing of the paper P brought in from the folding unit 4. The post-processing apparatus 2 includes a laminated paper supply unit (interposer) 6 that supplies laminated paper used as a booklet cover and the like to the transport unit 3. The post-processing apparatus 2 includes a paper processing controller 7 that controls operation of each functional unit of the post-processing apparatus 2.

The transport unit 3 includes a decurler 3*a*, one example of an output unit, an adjusting unit, and a reversing unit, that rectifies curl (curvature) of the paper P brought in from the image forming apparatus 1.

The folding unit 4 includes a folding functional unit 4*a* that performs folding such as inner tri-folding (so-called "C-folding") and outer tri-folding (so-called "Z-folding") of the paper P brought in from the transport unit 3.

The post-processing unit 5 includes a hole piercing functional unit 5*a* that performs, if necessary, hole piercing (punching) for piercing two holes, four holes, and the like on the paper P brought in from the folding unit 4. The post-processing unit 5 includes an end stitching functional unit 5*b* that stacks the paper P passing through the hole piercing functional unit 5*a* in required quantities to form a paper stack and performs stitching (end stitching) with a staple on an end portion of the formed paper stack. The post-processing unit 5 includes a center stitching functional unit 5*c* that stacks the paper P passing through the hole piercing functional unit 5*a* in required quantities to form a paper stack, performs stitching (center stitching) with a staple on a central portion of the formed paper stack, and performs folding of the central portion (center stitched portion) of the paper stack to form a booklet (performs a simple bookbinding work).

While the paper processing controller 7 in this example is illustratively configured to be provided in the post-processing unit 5 in the post-processing apparatus 2, the paper processing controller 7 may be provided in other units (the transport unit 3, the folding unit 4, and the laminated paper supply unit 6) constituting the post-processing apparatus 2. While the paper processing controller 7 in this example is illustratively configured to be provided in the post-processing apparatus 2, the paper processing controller 7 may be provided in the image forming apparatus 1. The main controller 14 and the paper processing controller 7 may not be separately provided. The main controller 14 may double as the paper processing controller 7.

Configuration of Image Forming Unit

Figure 2:
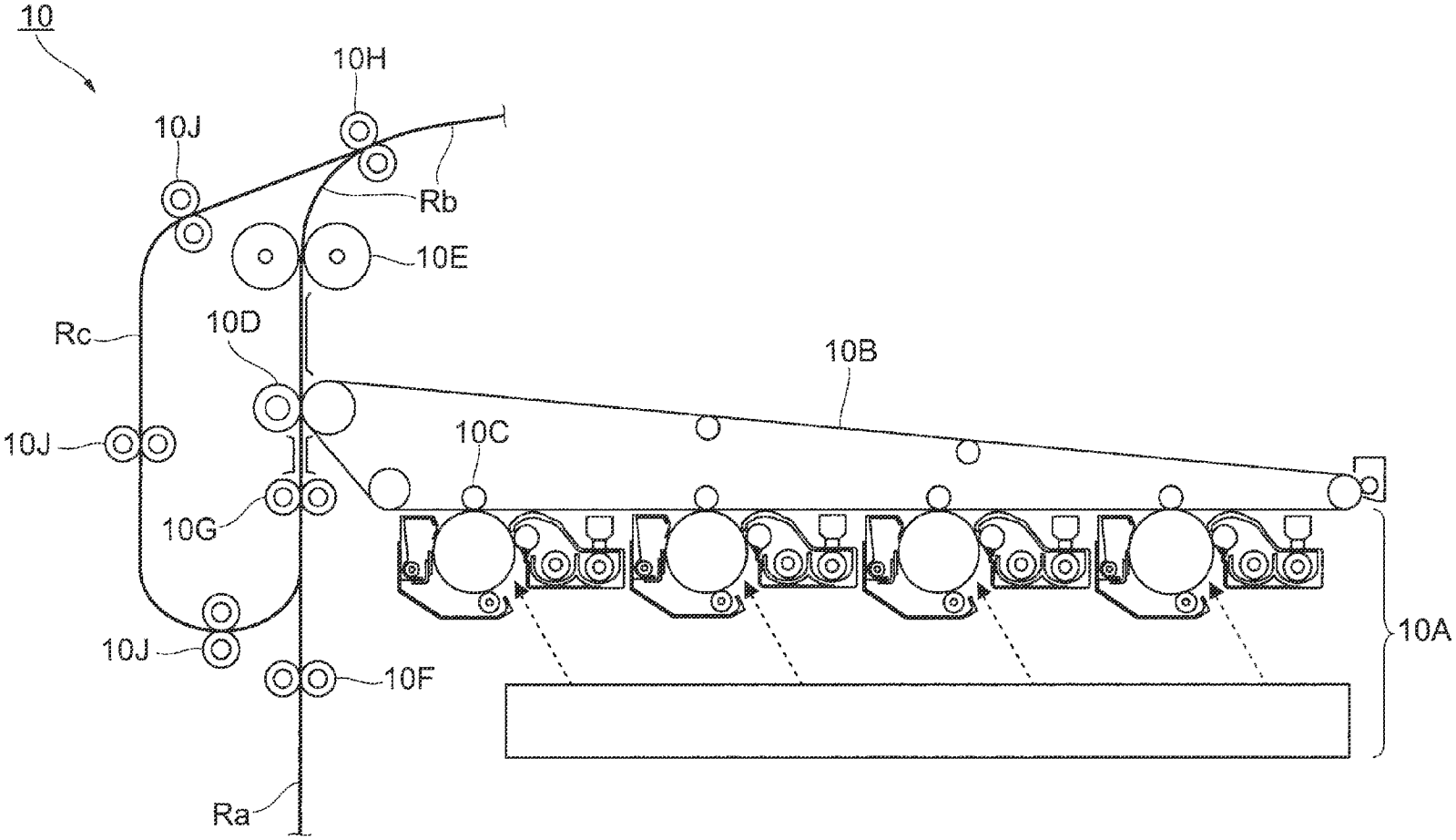
FIG. 2 is a diagram illustrating a configuration of an image forming unit provided in an image forming apparatus.

FIG. 2 is a diagram illustrating a configuration of the image forming unit 10 provided in the image forming apparatus 1.

The image forming unit 10, one example of an image forming unit and a supply unit, includes a toner image forming unit 10A that performs an electrophotographic process to form a toner image, an intermediate transfer belt 10B that is rotatably provided to face the toner image forming unit 10A, and a first transfer unit 10C that first transfers the toner image formed by the toner image forming unit 10A to the intermediate transfer belt 10B. The image forming unit 10 includes a second transfer unit 10D that second transfers the toner image first transferred to the intermediate transfer belt 10B to the paper P (refer to FIG. 1), and a fixing unit 10E, one example of a heating unit, that fixes the second transferred toner image to the paper P.

The image forming unit 10 includes a supply path Ra along which the paper P transported from the paper supply unit 12 (refer to FIG. 1) is supplied to the second transfer unit 10D, an output path Rb along which the paper P transported from the second transfer unit 10D is output to the paper relaying unit 15 (refer to FIG. 1) through the fixing unit 10E, and a reversal path Rc that is connected to the downstream side of the fixing unit 10E on the output path Rb and to the supply path Ra and along which the paper P passing through the fixing unit 10E is reversed inside out by reversing a transport direction thereof and supplied to the second transfer unit 10D again.

The image forming apparatus 1 that may be used alone is used in the present exemplary embodiment by being incorporated in the image forming system 500. When the image forming apparatus 1 is used alone, a paper output unit is provided at a position where the paper relaying unit 15 is attached, and the paper P after image formation is output face down to above the image forming apparatus 1. Thus, the output path Rb in the image forming unit 10 is provided to extend upward in FIG. 2 up to the fixing unit 10E and bend (curve) rightward in FIG. 2 after passing through the fixing unit 10E.

The angular difference between the transport direction of the paper P on an outlet side of the fixing unit 10E, that is, the part corresponding to the most upstream side of the output path Rb, and the transport direction of the paper P in the part corresponding to the downstream side of the output path Rb in the transport direction at a distance of 200 mm to 250 mm from the outlet side of the fixing unit 10E is set to be greater than or equal to 45 degrees on the output path Rb, one example of a curved transport path.

A transport roller 10F that transports the paper P transported from the paper supply unit 12 (refer to FIG. 1) is provided on the upstream side, in the transport direction, of the supply path Ra from the part of the supply path Ra where the supply path Ra joins the reversal path Rc. A registration roll 10G that aligns the position of the paper P supplied to the second transfer unit 10D is provided on the downstream side, in the transport direction, of the supply path Ra from the part of the supply path Ra where the supply path Ra joins the reversal path Rc. An output roll 10H that forwardly rotates to guide the paper P passing through the fixing unit 10E to the paper relaying unit 15 (refer to FIG. 1) or reversely rotates to guide the paper P to the reversal path Rc is provided in a forwardly and reversely rotatable manner near the part of the output path Rb where the output path Rb and the reversal path Rc branch off from each other. Multiple reversal transporting rolls 10J that guide the paper P brought in from the output path Rb to the supply path Ra are provided on the reversal path Rc.

Types of Folding

Figure 3:
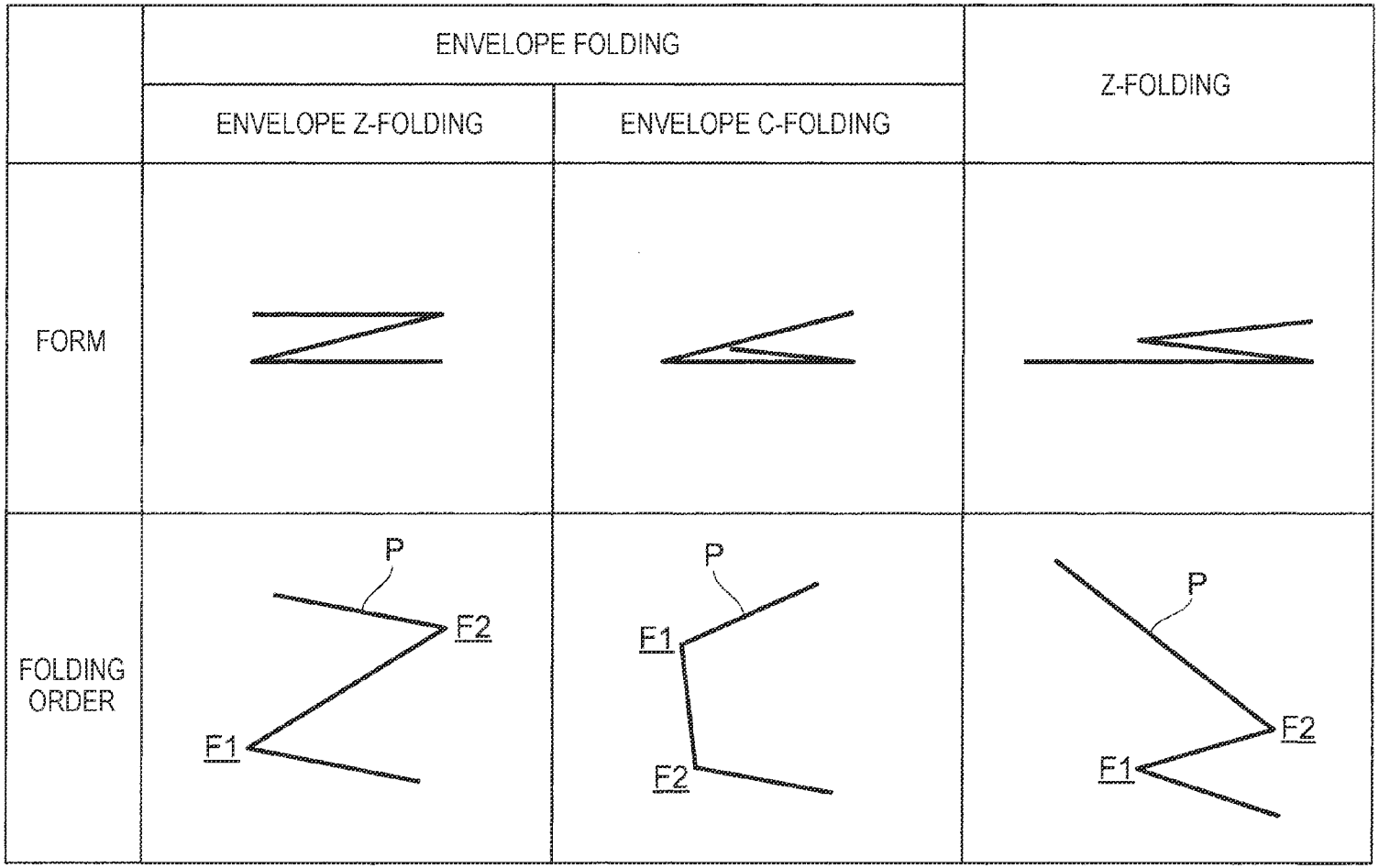
FIG. 3 is a diagram illustrating types of folding performed by a folding functional unit provided in a folding unit.

FIG. 3 is a diagram illustrating types of folding performed by the folding functional unit 4*a* provided in the folding unit 4.

The folding functional unit 4*a* of the present exemplary embodiment performs envelope folding in which the paper P is tri-folded into a nearly trisected (1:1:1) state in order to accommodate the paper P in an envelope, for example, and z-folding in which the paper P is tri-folded into a nearly 2:1:1 state by bi-folding one panel of the bi-folded paper P, thereby forming the folded shape of the paper P into the Z shape. The folding functional unit 4*a* of the present exemplary embodiment performs, as the envelope folding, envelope Z-folding in which the outer side of the paper P is tri-folded to form the folded shape of the paper P into the Z shape, and envelope C-folding in which the inner side of the paper P is tri-folded to form the folded shape of the paper P into the C shape. When the envelope folding (the envelope Z-folding and the envelope C-folding) and the Z-folding are performed in the present exemplary embodiment, a first fold F1 is formed by performing first folding of the paper P, and a second fold F2 is formed by performing second folding of the paper P in which the first fold F1 is formed. Therefore, folding is required to be performed twice in the envelope folding (the envelope Z-folding and the envelope C-folding) and the Z-folding.

Figure 4A:
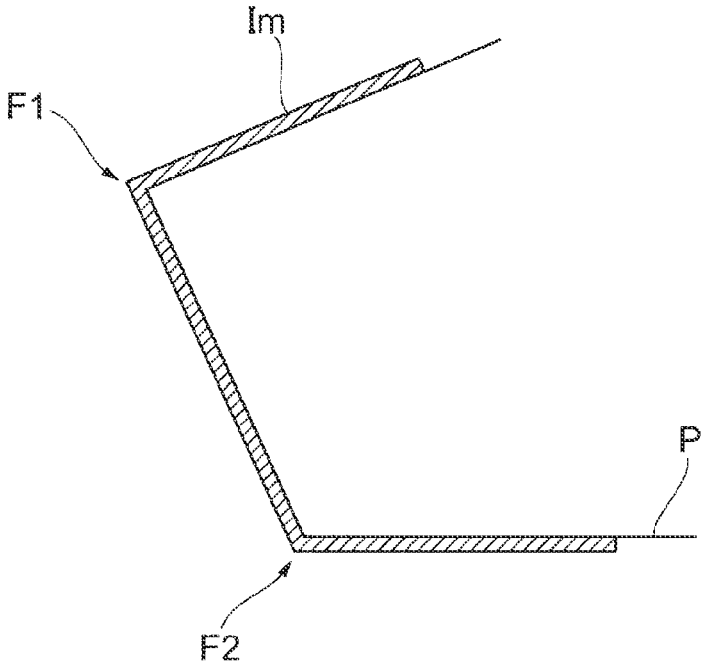
FIGS. 4A and 4B are diagrams illustrating types of envelope C-folding.
Figure 4B:
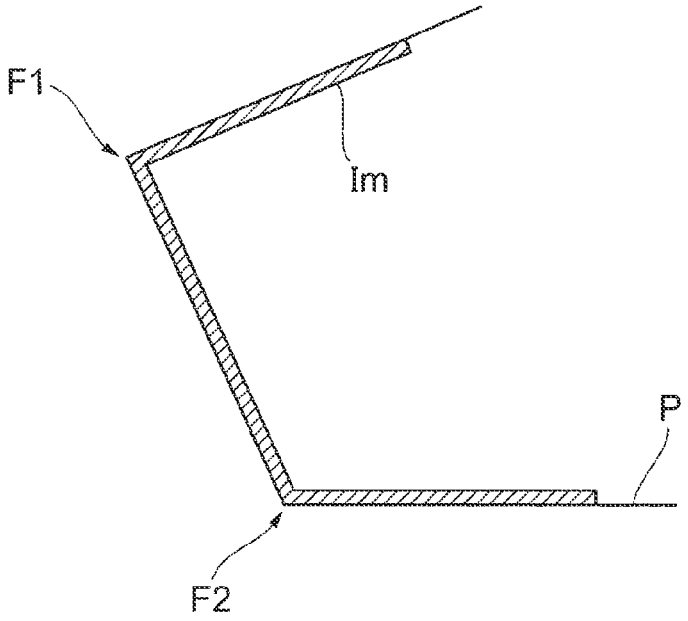

FIGS. 4A and 4B are diagrams illustrating types of the envelope C-folding. FIG. 4A illustrates outer image C-folding, and FIG. 4B illustrates inner image C-folding.

The outer image C-folding illustrated in FIG. 4A is one of the types of the envelope C-folding illustrated in FIG. 3 in which an image Im (toner image) formed one side of the paper P is positioned on the outer side of the paper P after folding. The inner image C-folding illustrated in FIG. 4B is one of the types of the envelope C-folding illustrated in FIG. 3 in which the image Im (toner image) formed one side of the paper P is positioned on the inner side of the paper P after folding. The image Im (toner image) formed on one side of the paper P is positioned on the outer side and the inner side of the paper P after folding in the envelope Z-folding and the Z-folding other than the envelope C-folding.

The outer tri-folding includes the envelope Z-folding and the Z-folding, and the inner tri-folding includes the envelope C-folding (the outer image C-folding and the inner image C-folding) in the present exemplary embodiment.

Configuration of Folding Functional Unit

Figure 5:
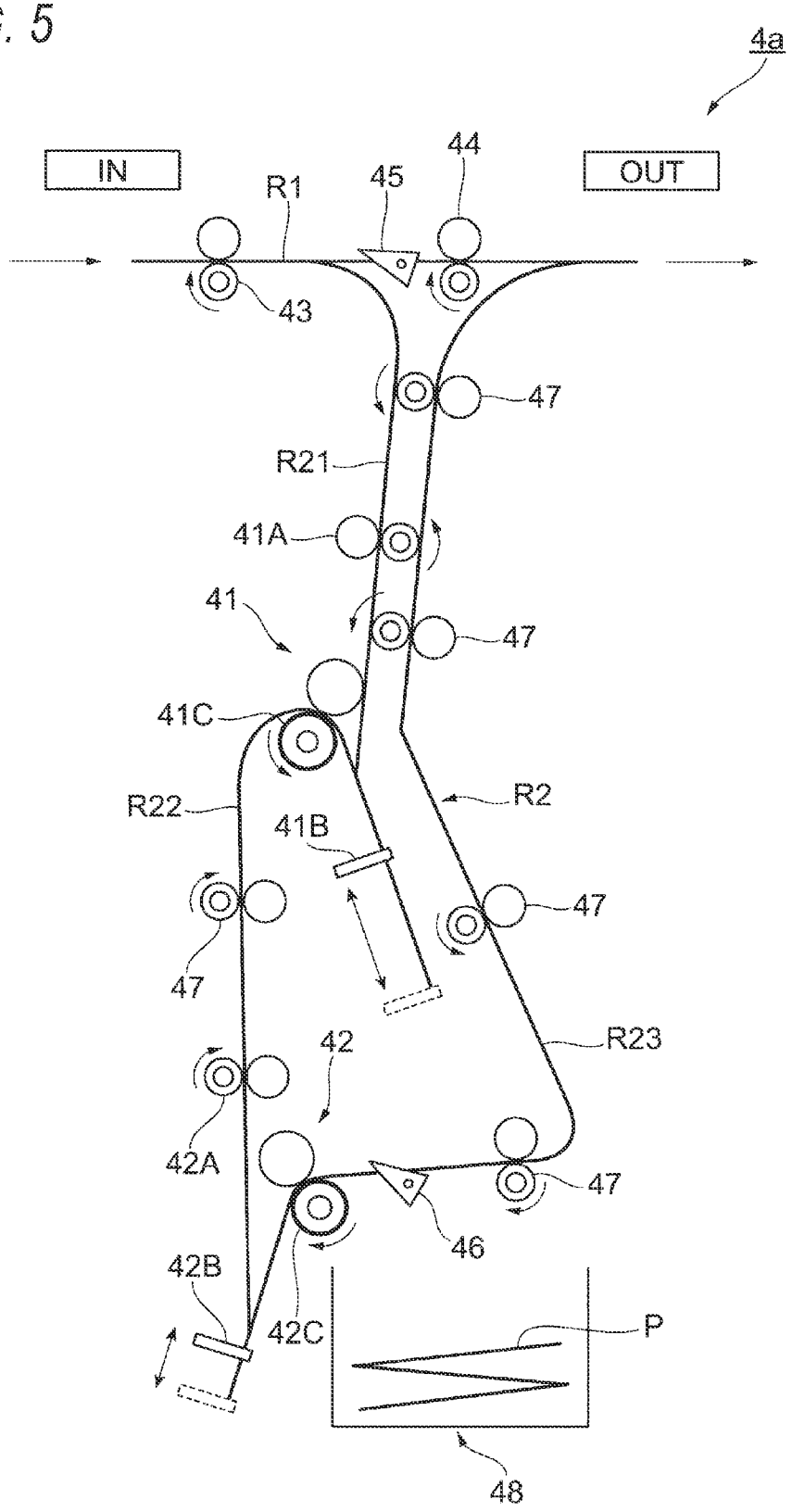
FIG. 5 is a diagram illustrating a configuration of the folding functional unit in the folding unit.

FIG. 5 is a diagram illustrating a configuration of the folding functional unit 4*a* in the folding unit 4.

The folding functional unit 4*a* of the present exemplary embodiment includes a straight transport path R1 that linearly straightly connects a paper inlet (IN) into which the paper P is brought from the transport unit 3 (refer to FIG. 1) and a paper outlet (OUT) from which the paper P is transported to the post-processing unit 5 (refer to FIG. 1), and a detour transport path R2 that is provided to branch off from midway of the straight transport path R1 and detour below the straight transport path R1. The folding functional unit 4*a* includes a first folding mechanism 41 that performs the first folding of the paper P, and a second folding mechanism 42 that performs the second folding of the paper P. The first folding mechanism 41 and the second folding mechanism 42 are provided on the detour transport path R2.

An intake roller (transport roller) 43 is provided in the inlet part of the straight transport path R1, and a dispensing roller (transport roller) 44 is provided midway of the straight transport path R1 in the folding functional unit 4*a*. A first switching gate 45 for switching the transport path of the paper P is provided in the part of the folding functional unit 4*a* where the straight transport path R1 and the detour transport path R2 branch off from each other. The detour transport path R2 includes an inlet detour transport path R21 that extends downward from the part where the straight transport path R1 and the detour transport path R2 branch off from each other, an intermediate detour transport path R22 that branches off in the C shape from midway of the inlet detour transport path R21, and a return detour transport path R23 that branches off from midway of the intermediate detour transport path R22 and returns to the straight transport path R1.

The first folding mechanism 41 is configured of a skew correction roller (doubles as a transport roller) 41A that is provided midway of the inlet detour transport path R21 and is provided immediately before a first folding position in a manner capable of nipping and releasing the paper P, a first end guide 41B that is provided on the terminal side of the inlet detour transport path R21 in a manner capable of moving upward and downward, and a first folding roll 41C that is provided on the inlet detour transport path R21 side of the intermediate detour transport path R22.

The second folding mechanism 42 includes a push roller (doubles as a transport roller) 42A that is provided midway of the intermediate detour transport path R22 and is provided immediate before a second folding position, a second end guide 42B that is provided on the terminal side of the intermediate detour transport path R22 in a manner capable of moving upward and downward, and a second folding roll 42C that is provided on the intermediate detour transport path R22 side of the return detour transport path R23. Multiple transport rollers 47 are provided on the detour transport path R2 in addition to the skew correction roller 41A and the push roller 42A.

A second switching gate 46 that switches between permitting passage to the return detour transport path R23 and not permitting passage thereto is provided immediately after the second folding roll 42C. A paper accommodating device 48 that accommodates the paper P subjected to the envelope folding (the envelope Z-folding or the envelope C-folding) is provided below the second switching gate 46. The first folding roll 41C functions as one example of a first folding unit, and the second folding roll 42C functions as one example of a second folding unit in the present exemplary embodiment. The first folding roll 41C and the second folding roll 42C respectively function as one example of an inner tri-folding unit and one example of an outer tri-folding unit.

Layout of Folding Functional Unit

Figure 6:
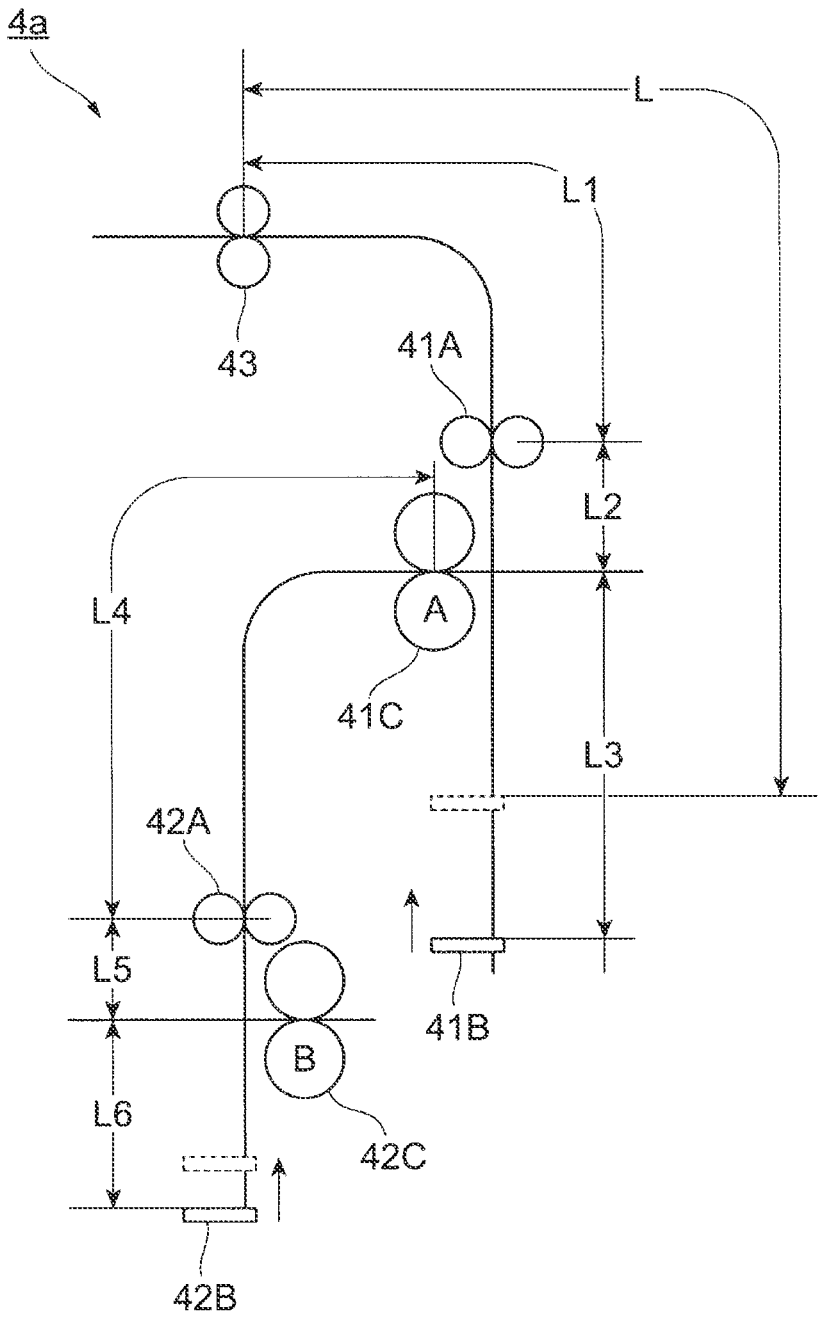
FIG. 6 is a diagram illustrating a layout of the folding functional unit.

FIG. 6 is a diagram illustrating a layout of the folding functional unit 4*a*.

Paper which is the target of the envelope folding in the present exemplary embodiment has a maximum size corresponding to JIS A4 and a minimum size equal to 8.5×11 [inches]. Paper which is the target of the Z-folding in the present exemplary embodiment has a maximum size equal to 11×17 [inches] and a minimum size corresponding to JIS B4.

The reference sign L in FIG. 6 is the length of passage of paper from the intake roller 43 to the first end guide 41B and is set to be greater than or equal to the maximum size of the paper which is the target of the Z-folding (11×17 [inches] in the present example).

A reference sign L1 is the length of passage of paper from the intake roller 43 to the skew correction roller 41A and is set to be less than or equal to the minimum size of the paper which is the target of the envelope folding (8.5×11 [inches] in the present example).

A reference sign L2 is the length of passage of paper from the skew correction roller 41A to a first nip position A of the first folding roll 41C and is set to be less than or equal to ⅓ of the minimum size of the paper which is the target of the envelope folding (8.5×11 [inches] in the present example).

A reference sign L3 is the length of passage of paper from the first nip position A of the first folding roll 41C to the first end guide 41B and is set to be equal to ⅓ of the size of the paper which is the target of the envelope Z-folding, ⅔ of the size of the paper which is the target of the envelope C-folding, or ¼ of the size of the paper which is the target of the Z-folding.

A reference sign L4 is the length of passage of paper from the first nip position A of the first folding roll 41C to the push roller 42A and is set to be less than or equal to ½ of the minimum size of the paper which is the target of the Z-folding (size corresponding to JIS B4 in the present example).

A reference sign L5 is the length of passage of paper from the push roller 42A to a second nip position B of the second folding roll 42C and is set to be less than or equal to ⅓ of the minimum size of the paper which is the target of the envelope folding (8.5×11 [inches] in the present example).

A reference sign L6 is the length of passage of paper from the second nip position B of the second folding roll 42C to the second end guide 42B and is set to be equal to ⅔ of the size of the paper which is the target of the envelope folding or ¼ of the size of the paper which is the target of the Z-folding.

Configuration of Control System

Figure 7:
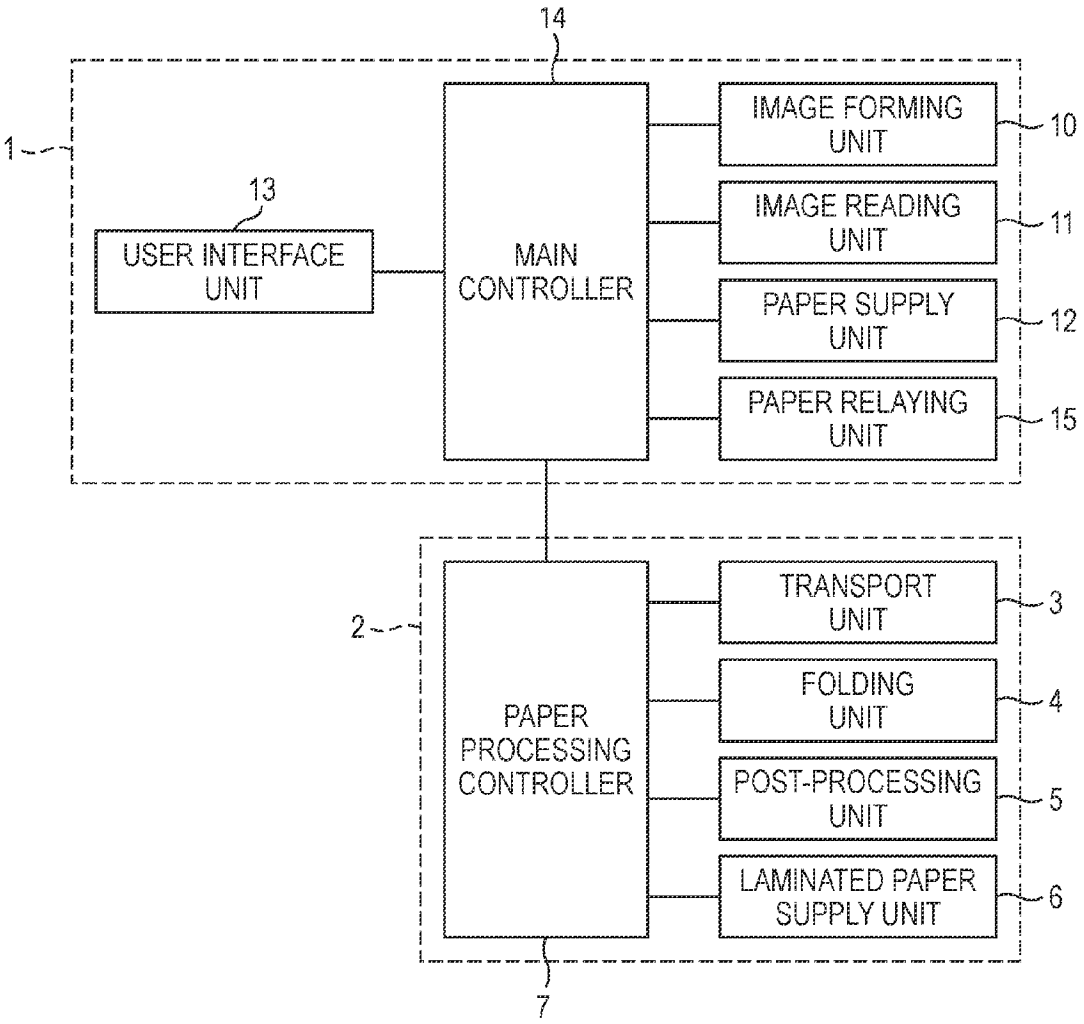
FIG. 7 is a block diagram related to control of the image forming system.

FIG. 7 is a block diagram related to control of the image forming system 500 of the present exemplary embodiment.

An instruction signal corresponding to an instruction received from the user is input from the user interface unit 13 into the main controller 14 provided in the image forming apparatus 1. The main controller 14 outputs control signals to the image forming unit 10, the image reading unit 11, the paper supply unit 12, and the paper relaying unit 15 provided in the image forming apparatus 1. The main controller 14 outputs a control signal to the paper processing controller 7 provided in the post-processing apparatus 2.

A control signal is input from the main controller 14 provided in the image forming apparatus 1 into the paper processing controller 7 provided in the post-processing apparatus 2. The paper processing controller 7 outputs control signals to the transport unit 3, the folding unit 4, the post-processing unit 5, and the laminated paper supply unit 6 provided in the post-processing apparatus 2. The paper processing controller 7 outputs a control signal to the main controller 14 provided in the image forming apparatus 1.

Description of Folding Operation

Next, a folding operation performed by the folding unit 4 (folding functional unit 4*a*) will be described. The folding unit 4 of the present exemplary embodiment, as described above, is capable of selectively performing, as folding, three processes (the envelope Z-folding, the envelope C-folding, and the Z-folding). Hereinafter, the processes will be described in order.

Envelope Z-Folding

Figure 8A:
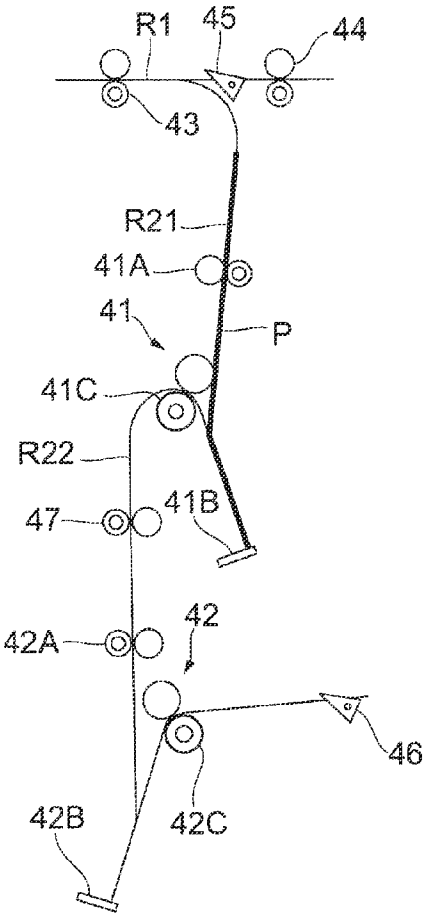
FIGS. 8A, 8B and 8C are diagrams illustrating progress in envelope Z-folding.
Figure 8B:
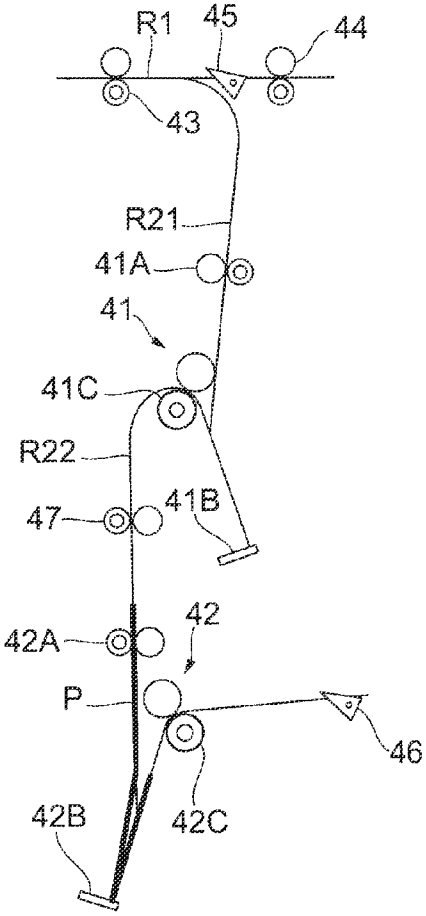
Figure 8C:
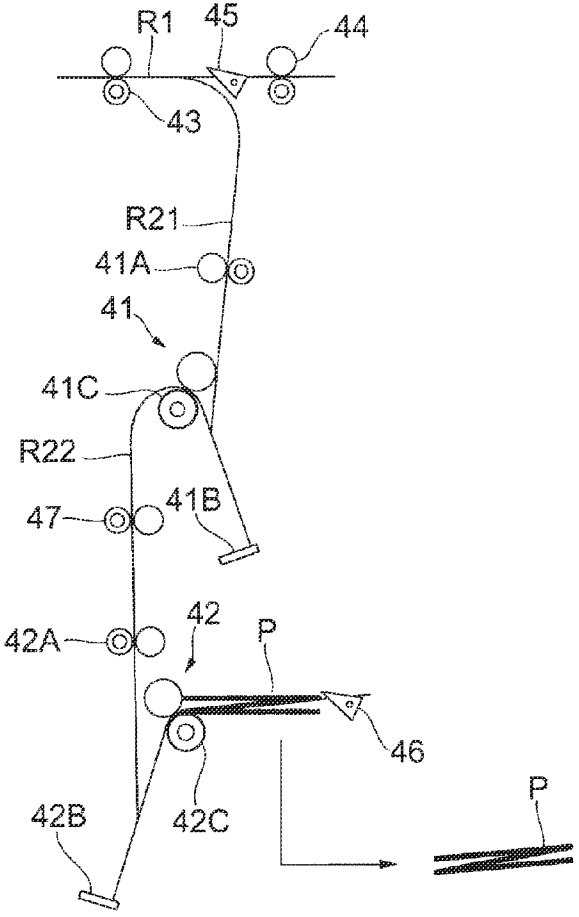

FIGS. 8A to 8C are diagrams illustrating progress in the envelope Z-folding.

It is assumed that a job in which the paper P of a small size put into an envelope (for example, JIS A4 short edge feed (SEF)), after the image Im is formed thereon by the image forming apparatus 1, is subjected to the envelope Z-folding by the folding unit 4 and is then output to the paper accommodating device 48 is performed.

First, a toner image (the image Im) is transferred and fixed to the paper P in the image forming apparatus 1, and the paper P is relayed to the post-processing apparatus 2. The paper P after image formation that is output from the image forming apparatus 1 is relayed to the folding unit 4 via the transport unit 3 after, if necessary, curl thereof is rectified by the decurler 3*a*.

The first switching gate 45 is provided in the folding unit 4 (folding functional unit 4*a*) in a position permitting movement of the paper P to the detour transport path R2 as illustrated in FIG. 5 in accordance with a job specification "envelope Z-folding mode" received through the user interface unit 13.

The first end guide 41B and the second end guide 42B are moved to target positions thereof, and the second switching gate 46 is provided in a position preventing movement of the paper P to the return detour transport path R23. Particularly, the positions of the first end guide 41B and the second end guide 42B are adjusted in such a manner that both L3 and L6 illustrated in FIG. 6 are equal to ⅓ of the size of the target paper (JIS A4 SEF in the present example).

The paper P, in this state, is transported from the straight transport path R1 to the inlet detour transport path R21 and is guided to the first folding mechanism 41 via the skew correction roller 41A, and the leading edge of the paper P abuts the first end guide 41B and stops as illustrated in FIG. 8A. At this point, when the paper P is transported to the first folding roll 41C in a curved attitude in a case where the paper P is put in a skewed manner in the image forming apparatus 1 or skewed midway of the transport path of the transport unit 3, the accuracy of the position of a fold is decreased. Therefore, skew correction is performed of the paper P by using the skew correction roller 41A in the present exemplary embodiment.

This skew correction method includes causing the leading edge of the paper P to abut the first end guide 41B while transporting the paper P in a nipped manner with the skew correction roller 41A, transporting the paper P a few mm (for example, approximately 5 mm) further therefrom to form a loop on the leading edge side of the paper P, and releasing nipping of the skew correction roller 41A. In this case, when the nipping by the skew correction roller 41A is released, the loop formed in the paper P is straightened. Thus, the leading edge of the paper P becomes horizontal along the first end guide 41B, and the trailing edge of the paper P becomes horizontal following the leading edge of the paper P. Accordingly, skew of the paper P is corrected.

Next, the paper P after the end of skew correction is again nipped by the skew correction rollers 41A and is transported at a slightly higher speed than the first folding roll 41C to buckle the paper P in a space in front of the first folding roll 41C and to form a loop.

The paper P is transported to the first folding roll 41C and is subjected to the first folding (forming the first fold F1 of the envelope Z-folding illustrated in FIG. 3) in the first nip position A (refer to FIG. 6).

Next, as illustrated in FIG. 8B, the paper P after the end of the first folding is guided to the second folding mechanism 42. The paper P is transported through the push roller 42A, and the leading edge thereof, the first fold F1 made by the first folding, is then caused to abut the second end guide 42B to form a loop on the trailing edge side of the paper P. Then, the paper P is transported to the second folding roll 42C and is subjected to the second folding (forming the second fold F2 of the envelope Z-folding illustrated in FIG. 3) in the second nip position B (refer to FIG. 6). At this point, skew correction is not required since skew correction is previously performed in front of the first folding roll 41C.

Then, the paper P subjected to the envelope Z-folding after the end of the second folding is guided by the second switching gate 46 and is output to the paper accommodating device 48 (refer to FIG. 5) as illustrated in FIG. 8C.

An envelope Z-folding operation for one sheet of the paper P is completed as described heretofore.

Envelope C-Folding

Figure 9A:
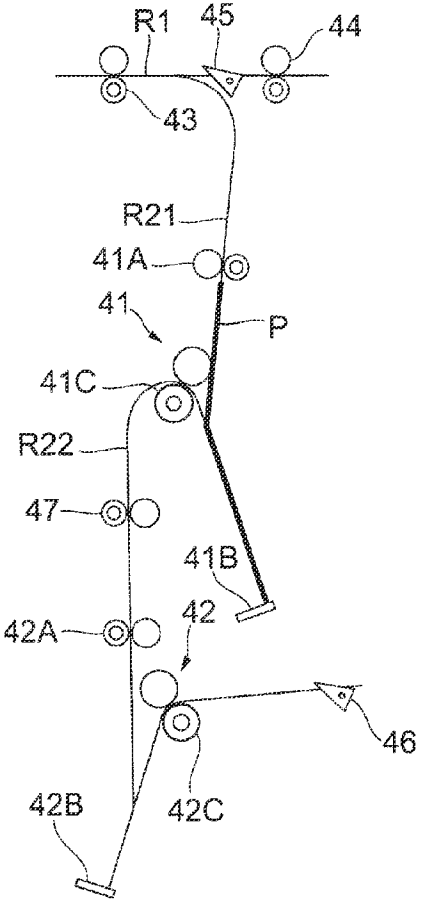
FIGS. 9A, 9B and 9C are diagrams illustrating progress in envelope C-folding.
Figure 9B:
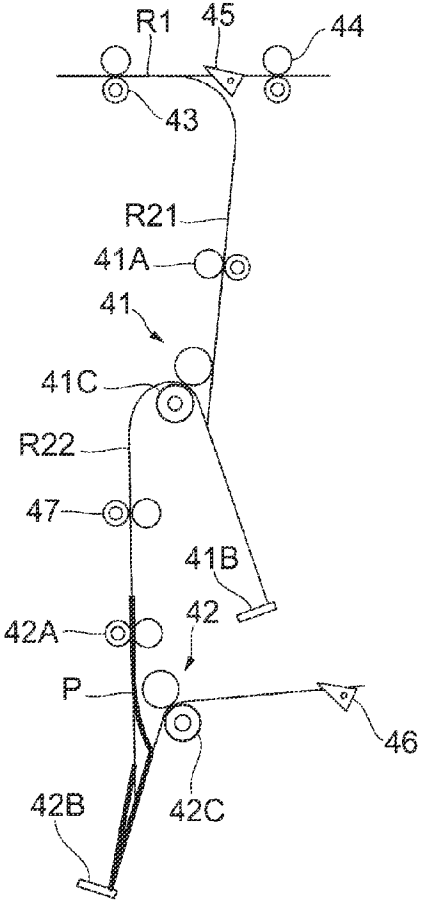
Figure 9C:
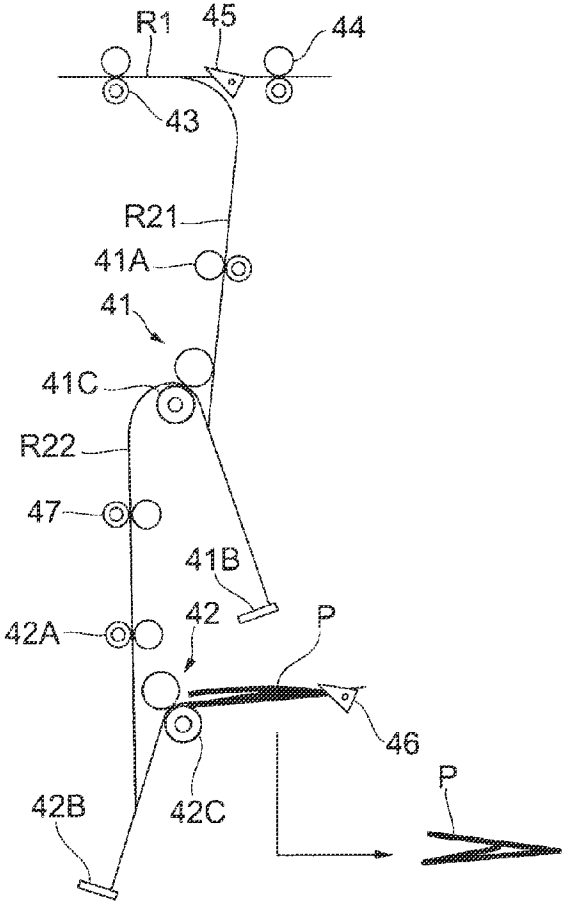

FIGS. 9A to 9C are diagrams illustrating progress in the envelope C-folding.

It is assumed that a job in which the paper P of a small size put into an envelope (for example, JIS A4 SEF), after the image Im is formed thereon by the image forming apparatus 1, is subjected to the envelope C-folding by the folding unit 4 and is then output to the paper accommodating device 48 is performed.

First, in the same manner as described in the case of the envelope Z-folding above, a toner image (the image Im) is transferred and fixed to the paper P in the image forming apparatus 1, and the paper P after image formation is relayed to the post-processing apparatus 2. The paper P after image formation that is output from the image forming apparatus 1 is relayed to the folding unit 4 via the transport unit 3 after, if necessary, curl thereof is rectified by the decurler 3*a*.

The first switching gate 45 is provided in the folding unit 4 (folding functional unit 4*a*) in a position permitting movement of the paper P to the detour transport path R2 as illustrated in FIG. 5 in accordance with a job specification "envelope C-folding mode" received through the user interface unit 13.

The first end guide 41B and the second end guide 42B are moved to target positions thereof, and the second switching gate 46 is provided in a position preventing movement of the paper P to the return detour transport path R23. Particularly, the position of the first end guide 41B is adjusted differently from the envelope Z-folding mode in such a manner that L3 illustrated in FIG. 6 are equal to ⅔ of the size of the target paper (JIS A4 SEF in the present example). At this point, the position of the second end guide 42B is the same as that in the envelope Z-folding mode.

The paper P, in this state, is transported from the straight transport path R1 to the inlet detour transport path R21 and is guided to the first folding mechanism 41 via the skew correction roller 41A, and the leading edge of the paper P abuts the first end guide 41B and stops as illustrated in FIG. 9A. Next, the paper P is subjected to skew correction by using the skew correction roller 41A and is then subjected to the first folding (forming the first fold F1 of the envelope C-folding illustrated in FIG. 3) by the first folding roll 41C in the first nip position A (refer to FIG. 6).

Next, as illustrated in FIG. 9B, the paper P after the end of the first folding is guided to the second folding mechanism 42. The paper P is transported through the push roller 42A, and the leading edge thereof, the first fold F1 made by the first folding, is then caused to abut the second end guide 42B to form a loop on the trailing edge side of the paper P. Then, the paper P is transported to the second folding roll 42C and is subjected to the second folding (forming the second fold F2 of the envelope C-folding illustrated in FIG. 3) in the second nip position B (refer to FIG. 6).

Then, the paper P subjected to the envelope C-folding after the end of the second folding is guided by the second switching gate 46 and is output to the paper accommodating device 48 (refer to FIG. 5) as illustrated in FIG. 9C.

An envelope C-folding operation for one sheet of the paper P is completed as described heretofore.

Z-Folding

Figure 10A:
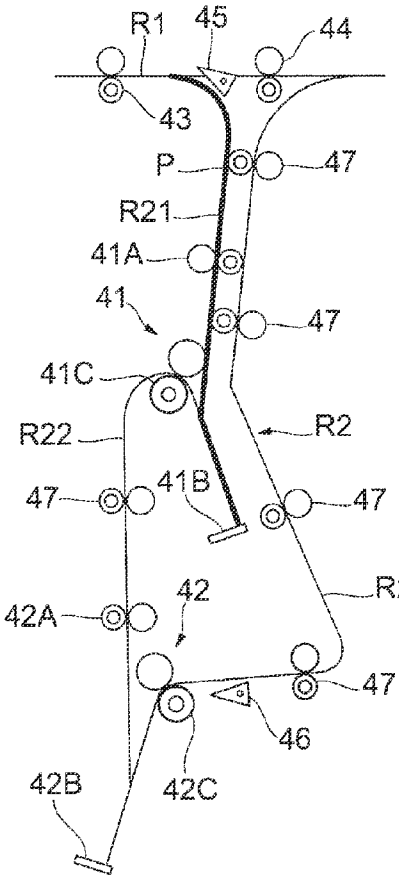
FIGS. 10A, 10B and 10C are diagrams illustrating progress in Z-folding.
Figure 10B:
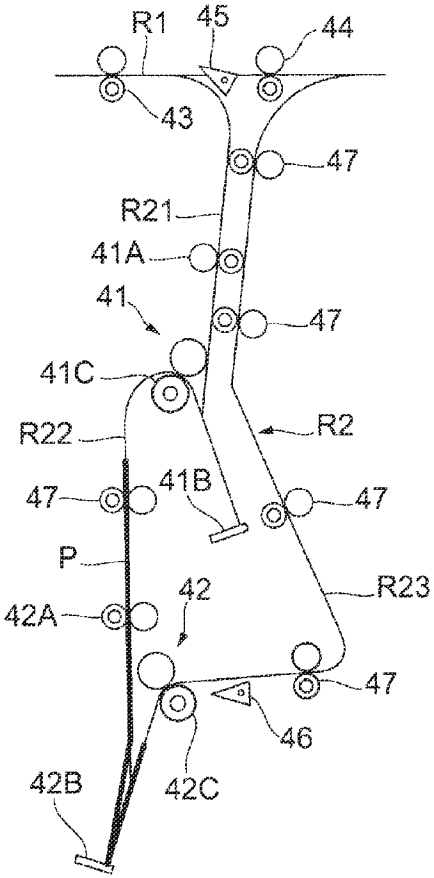
Figure 10C:
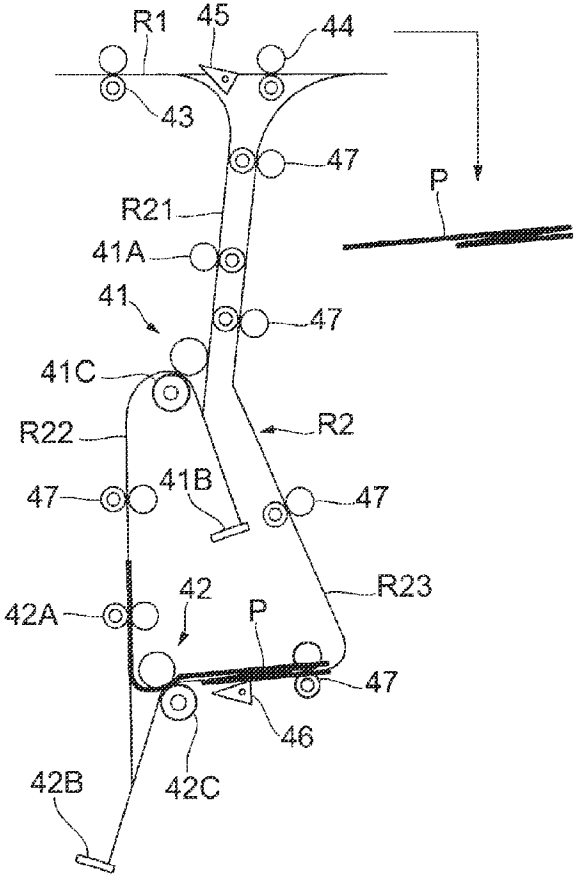

FIGS. 10A to 10C are diagrams illustrating progress in the Z-folding.

It is assumed that a job in which the paper P of a size larger than that in the case of the envelope Z-folding and the envelope C-folding described above (for example, JIS A3 SEF), after the image Im is formed thereon by the image forming apparatus 1, is subjected to the Z-folding by the folding unit 4 and is then output to the post-processing unit 5 (refer to FIG. 1) is performed.

First, in the same manner as described in the case of the envelope Z-folding and the envelope C-folding above, a toner image (the image Im) is transferred and fixed to the paper P in the image forming apparatus 1, and the paper P after image formation is relayed to the post-processing apparatus 2. The paper P after image formation that is output from the image forming apparatus 1 is relayed to the folding unit 4 via the transport unit 3 after, if necessary, curl thereof is rectified by the decurler 3*a*.

The first switching gate 45 is provided in the folding unit 4 (folding functional unit 4*a*) in a position permitting movement of the paper P to the detour transport path R2 as illustrated in FIG. 5 in accordance with a job specification "Z-folding mode" received through the user interface unit 13.

The first end guide 41B and the second end guide 42B are moved to target positions thereof, and the second switching gate 46 is provided in a position, different from that in the envelope folding (the envelope Z-folding and the envelope C-folding), permitting movement of the paper P to the return detour transport path R23. Particularly, the positions of the first end guide 41B and the second end guide 42B are adjusted differently from the envelope folding in such a manner that L3 and L6 illustrated in FIG. 6 are equal to ¼ of the size of the target paper (JIS A3 SEF in the present example).

The paper P, in this state, is transported from the straight transport path R1 to the detour transport path R2 and is guided to the first folding mechanism 41 via the skew correction roller 41A, and the leading edge of the paper P abuts the first end guide 41B and stops as illustrated in FIG. 10A. Next, the paper P is subjected to skew correction by using the skew correction roller 41A and is then subjected to the first folding (forming the first fold F1 of the Z-folding illustrated in FIG. 3) by the first folding roll 41C in the first nip position A (refer to FIG. 6).

Next, as illustrated in FIG. 10B, the paper P after the end of the first folding is guided to the second folding mechanism 42. The paper P is transported through the push roller 42A, and the leading edge thereof, the first fold F1 made by the first folding, is then caused to abut the second end guide 42B to form a loop on the central side of the paper P.

Then, the paper P is transported to the second folding roll 42C and is subjected to the second folding (forming the second fold F2 of the Z-folding illustrated in FIG. 3) in the second nip position B (refer to FIG. 6).

Then, the paper P subjected to the Z-folding after the end of the second folding is transported by the second switching gate 46 to the return detour transport path R23 and is then transported to the post-processing unit 5 (refer to FIG. 1) as illustrated in FIG. 10C.

A Z-folding operation for one sheet of the paper P is completed as described heretofore.

Image Output Mode

Figure 11A:
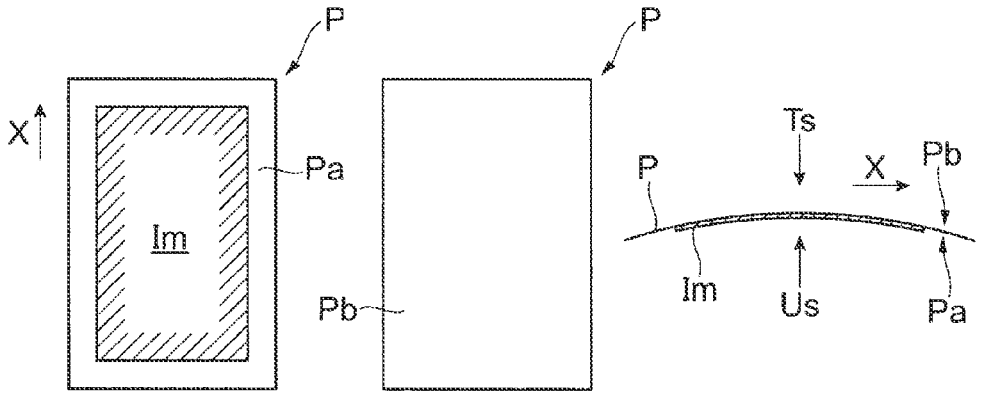
FIGS. 11A and 11B are diagrams illustrating image output modes performed by the image forming apparatus.
Figure 11B:
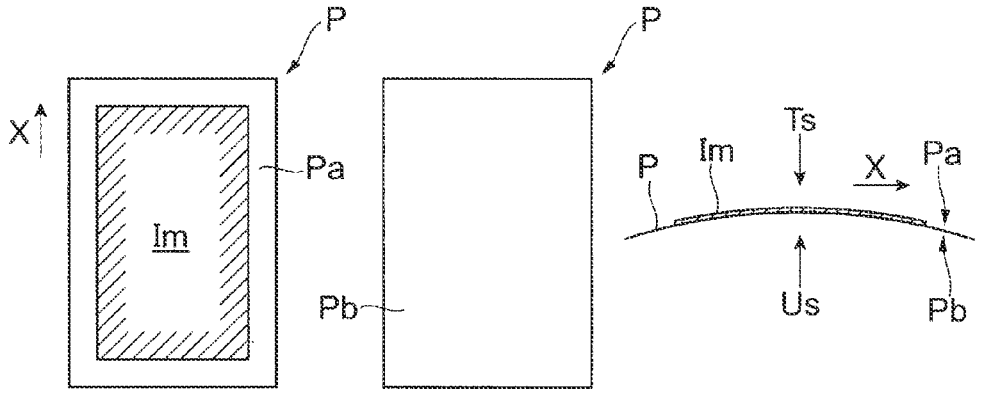

FIGS. 11A and 11B are diagrams illustrating image output modes performed by the image forming apparatus 1. FIG. 11A illustrates the paper P that is output from the image forming apparatus 1 in "regular output mode", and FIG. 11B illustrates the paper P that is output from the image forming apparatus 1 in "reversed output mode". Description will be provided with reference to FIG. 1 and FIG. 2 as well.

Regular Output Mode

First, in the regular output mode, the image Im is transferred by the second transfer unit 10D to a front side Pa of the paper P that is supplied from the paper supply unit 12 and is transported into the supply path Ra. The paper P that is subjected to heating (fixing) by passing through the second transfer unit 10D and the fixing unit 10E and is relayed from the output path Rb to the paper relaying unit 15. The regular output mode forms the image Im on the front side Pa of the paper and does not form the image Im on a rear side Pb of the paper P as illustrated in FIG. 11A. In this case, an upper side Ts of the paper P that is output from the paper relaying unit 15 in a transport direction X corresponds to the rear side Pb (where the image Im is not formed), and a lower side Us of the paper P corresponds to the front side Pa (where the image Im is formed). Downcurl that is illustrated as "convex upward" in FIG. 11A is generated in the regular output mode in the paper P output from the image forming unit 10 through the paper relaying unit 15 when the paper P passes through the fixing unit 10E (heated) for the first time and then passes through a curved part of the output path Rb. As a result, the rear side Pb (where the image Im is not formed) corresponding to the upper side Ts of the paper P supplied from the image forming apparatus 1 to the transport unit 3 becomes convex, and the front side Pa (where the image Im is formed) corresponding to the lower side Us of the paper P becomes concave.

Reversed Output Mode

In the reversed output mode, the image Im is transferred by the second transfer unit 10D to the front side Pa of the paper P that is supplied from the paper supply unit 12 and is transported into the supply path Ra in the same manner as the regular output mode. The difference from the regular output mode is that in the reversed output mode, the paper P on which the image Im is heated (fixed) by passing through the second transfer unit 10D and the fixing unit 10E is guided to the output path Rb, is then guided from the output path Rb to the reversal path Rc by reversing the transport direction, and is guided from the reversal path Rc to the supply path Ra again. Accordingly, the paper P that is brought again into the supply path Ra is reversed inside out in addition to the transport direction. Next, the second transfer unit 10D does not transfer the image Im to the rear side Pb of the paper P transported again into the supply path Ra and passes the paper P. The paper P that is subjected to heating again by passing through the second transfer unit 10D and the fixing unit 10E and is relayed from the output path Rb to the paper relaying unit 15. The reversed output mode, in the same manner as the regular output mode, forms the image Im on the front side Pa of the paper and does not form the image Im on the rear side Pb of the paper P. In this case, the upper side Ts of the paper P that is output from the paper relaying unit 15 in the transport direction X corresponds to the front side Pa (where the image Im is formed), and the lower side Us of the paper P corresponds to the rear side Pb (where the image Im is not formed). Downcurl that is illustrated as "convex upward" is generated in the reversed output mode in the paper P output from the image forming unit 10 through the paper relaying unit 15 when the paper P passes through the fixing unit 10E (heated) for the second time and then passes through a curved part of the output path Rb. As a result, the front side Pa (where the image Im is formed) corresponding to the upper side Ts of the paper P supplied from the image forming apparatus 1 to the transport unit 3 becomes convex, and the rear side Pb (where the image Im is not formed) corresponding to the lower side Us of the paper P becomes concave.

The lower side Us of the paper P corresponds to one side of the sheet, and the upper side Ts of the paper P corresponds to the other side of the sheet in the present exemplary embodiment. The lower side Us of the paper P corresponds to a first facing side, and the upper side Ts of the paper P corresponds to a second facing side in the present exemplary embodiment.

Relationship Between Folding Mode, Image Output Mode, and Setting for Decurler

In the image forming system 500 of the present exemplary embodiment, the image output mode in the image forming apparatus 1 and a setting for the decurler 3*a* in the transport unit 3 are configured to be switched according to the folding mode set in the image forming system 500 on the basis of a job specification received through the user interface unit 13.

FIG. 12 is a diagram illustrating a relationship among the folding mode, the image output mode, and the setting for the decurler 3*a* in the present exemplary embodiment.

First, the image output mode of the image forming apparatus 1 is set to "regular output mode", and the decurler 3*a* in the transport unit 3 is set to "maintain a curl direction (convex upward)" in a case where "folding is not performed" of the paper P by the folding unit 4 (folding mode: no).

The image output mode of the image forming apparatus 1 is set to "regular output mode", and the decurler 3*a* in the transport unit 3 is set to "maintain a curl direction (convex upward)" in a case where "envelope Z-folding" is performed of the paper P by the folding unit 4 (folding mode: envelope Z-folding).

The image output mode of the image forming apparatus 1 is set to "regular output mode", and the decurler 3*a* in the transport unit 3 is set to "change a curl direction (convex downward)" in a case where "outer image C-folding" is performed of the paper P by the folding unit 4 (folding mode: outer image C-folding (envelope C-folding)).

The image output mode of the image forming apparatus 1 is set to "reversed output mode", and the decurler 3*a* in the transport unit 3 is set to "change a curl direction (convex downward)" in a case where "inner image C-folding" is performed of the paper P by the folding unit 4 (folding mode: inner image C-folding (envelope C-folding)).

The image output mode of the image forming apparatus 1 is set to "regular output mode", and the decurler 3*a* in the transport unit 3 is set to "maintain a curl direction (convex upward)" in a case where "Z-folding" is performed of the paper P by the folding unit 4 (folding mode: Z-folding).

Relationship Between Folding Mode and Curl of Paper

A relationship between the folding mode and curl of the paper P in the image forming system 500 of the present exemplary embodiment will be described. Four folding modes (the envelope Z-folding mode, an outer image C-folding mode (the envelope C-folding), an inner image C-folding mode (the envelope C-folding), and the Z-folding mode) may be selectively performed in the image forming system 500 of the present exemplary embodiment.

Hereinafter, the folding modes will be described in order.

Envelope Z-Folding Mode

Figure 13A:
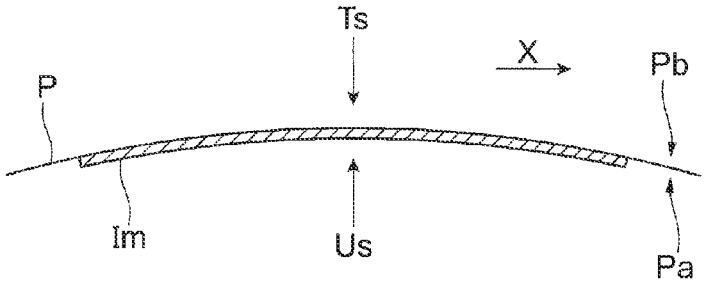
FIGS. 13A, 13B and 13C are diagrams illustrating a relationship between a paper subjected to folding and curl of the paper in an envelope Z-folding mode.
Figure 13B:
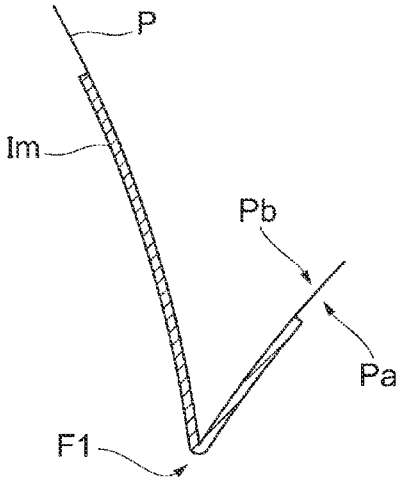
Figure 13C:
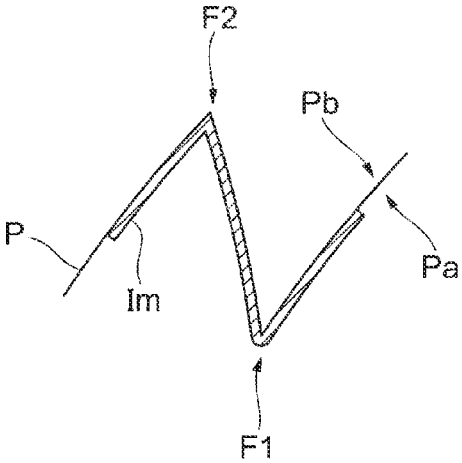

FIGS. 13A to 13C are diagrams illustrating a relationship between the paper P subjected to folding and curl of the paper P in the envelope Z-folding mode.

FIG. 13A illustrates the paper P at the intake thereof in which the paper P is transported in the transport direction X and passes through the intake roller 43 provided on the straight transport path R1 of the folding functional unit 4*a*. FIG. 13B illustrates the paper P after first fold formation in which the first fold F1 is formed by passing the paper P through the first folding mechanism 41 provided on the detour transport path R2 of the folding functional unit 4*a*. FIG. 13C illustrates the paper P after second fold formation in which the second fold F2 is formed by passing the paper P through the second folding mechanism 42 provided on the detour transport path R2 of the folding functional unit 4*a*. The relationships illustrated in FIGS. 13A to 13C also apply to FIGS. 14A to 14C to FIGS. 16A to 16C described below.

As illustrated in FIG. 12, the image output mode of the image forming apparatus 1 is set to "regular output mode", and the decurler 3*a* in the transport unit 3 is set to "maintain a curl direction (convex upward)" in the envelope Z-folding mode. Thus, the paper P at the intake thereof is such that the upper side Ts of the paper P corresponds to the rear side Pb (where the image Im is not formed) and that the lower side Us of the paper P corresponds to the front side Pa (where the image Im is formed) in accordance with "regular output mode" as illustrated in FIG. 13A (refer to FIG. 11A as well). The paper P at the intake thereof is "convex upward", that is, the rear side Pb (where the image Im is not formed) corresponding to the upper side Ts being convex and the front side Pa (where the image Im is formed) corresponding to the lower side Us being concave, in accordance with the setting "maintain a curl direction" for the decurler 3*a* as illustrated in FIG. 13A.

Next, the paper P enters the first nip position A in such a manner that the concave front side Pa comes in contact with the first folding roll 41C provided in the first folding mechanism 41. As a result, the first fold F1 that looks like a mountain fold when seen from the front side Pa side of the paper P (a valley fold when seen from the rear side Pb side of the paper P) is formed in a part of the paper P passing through the first nip position A on the leading edge side of the paper P from the center as illustrated in FIG. 13B. At this point, since the image Im is formed on the front side Pa of the paper P, the image Im is positioned on the outer side of the folded paper P after the first fold F1 is formed in the paper P.

Then, the paper P in which the first fold F1 is formed enters the second nip position B in such a manner that the convex rear side Pb comes in contact with the second folding roll 42C provided in the second folding mechanism 42. As a result, the second fold F2 that looks like a mountain fold when seen from the rear side Pb side of the paper P (a valley fold when seen from the front side Pa side of the paper P) is formed in a part of the paper P passing through the second nip position B on the trailing edge side of the paper P from the center as illustrated in FIG. 13C. At this point, since the image Im is formed on the front side Pa of the paper P, the image Im is positioned on the outer side (around the first fold F1) and the inner side (around the second fold F2) of the folded paper P after the second fold F2 is formed in the paper P.

Outer Image C-Folding Mode

Figure 14A:
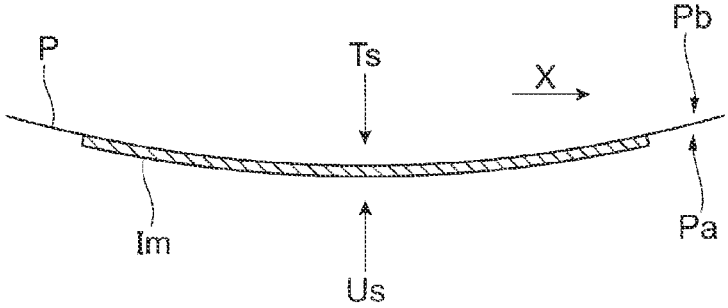
FIGS. 14A, 14B and 14C are diagrams illustrating a relationship between a paper subjected to folding and curl of the paper in an outer image C-folding mode.
Figure 14B:
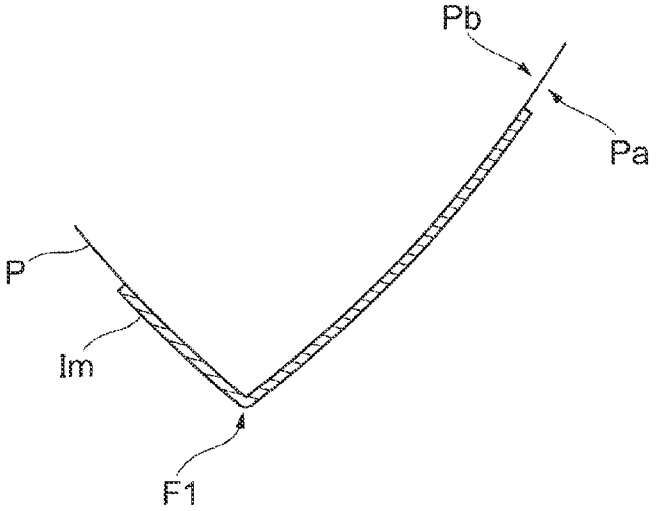
Figure 14C:
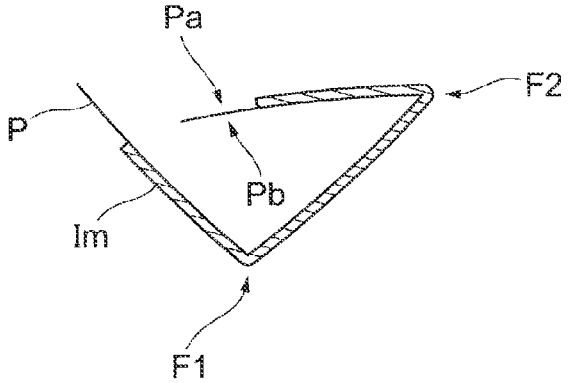

FIGS. 14A to 14C are diagrams illustrating a relationship between the paper P subjected to folding and curl of the paper P in the outer image C-folding mode.

As illustrated in FIG. 12, the image output mode of the image forming apparatus 1 is set to "regular output mode", and the decurler 3*a* in the transport unit 3 is set to "change a curl direction (convex downward)" in the outer image C-folding mode. Thus, the paper P at the intake thereof is such that the upper side Ts of the paper P corresponds to the rear side Pb (where the image Im is not formed) and that the lower side Us of the paper P corresponds to the front side Pa (where the image Im is formed) in accordance with "regular output mode" as illustrated in FIG. 14A (refer to FIG. 11A as well). The paper P at the intake thereof is "convex downward", that is, the rear side Pb (where the image Im is not formed) corresponding to the upper side Ts being concave and the front side Pa (where the image Im is formed) corresponding to the lower side Us being convex, in accordance with the setting "change a curl direction" for the decurler 3*a* as illustrated in FIG. 14A.

What is common to the outer image C-folding mode and the envelope Z-folding mode (refer to FIGS. 13A to 13C) is that the front side Pa of the paper P at the intake thereof corresponds to the lower side Us. The difference from the envelope Z-folding mode is that curl of the paper P at the intake thereof is "convex downward" in the outer image C-folding mode, while curl of the paper P at the intake thereof is "convex upward" in the envelope Z-folding mode.

Next, the paper P enters the first nip position A in such a manner that the convex front side Pa comes in contact with the first folding roll 41C provided in the first folding mechanism 41. As a result, the first fold F1 that looks like a mountain fold when seen from the front side Pa side of the paper P (a valley fold when seen from the rear side Pb side of the paper P) is formed in a part of the paper P passing through the first nip position A on the trailing edge side of the paper P from the center as illustrated in FIG. 14B. At this point, since the image Im is formed on the front side Pa of the paper P, the image Im is positioned on the outer side of the folded paper P after the first fold F1 is formed in the paper P.

Then, the paper P in which the first fold F1 is formed enters the second nip position B in such a manner that the convex front side Pa comes in contact with the second folding roll 42C provided in the second folding mechanism 42. As a result, the second fold F2 that looks like a mountain fold when seen from the front side Pa side of the paper P (a valley fold when seen from the rear side Pb side of the paper P) is formed in a part of the paper P passing through the second nip position B on the leading edge side of the paper P from the center as illustrated in FIG. 14C. At this point, since the image Im is formed on the front side Pa of the paper P, the image Im is positioned on the outer side (mountain fold side) of the paper P folded at two places after the second fold F2 is formed in the paper P.

Inner Image C-Folding Mode

Figure 15A:
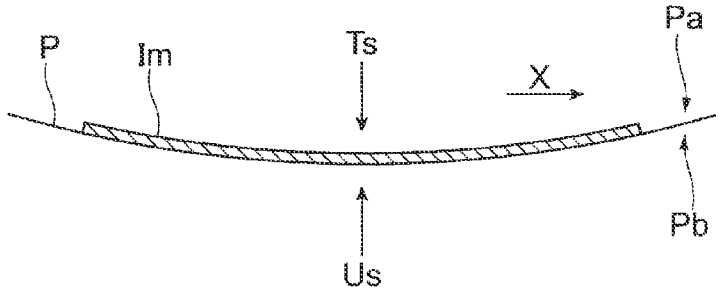
FIGS. 15A, 15B and 15C are diagrams illustrating a relationship between a paper subjected to folding and curl of the paper in an inner image C-folding mode.
Figure 15B:
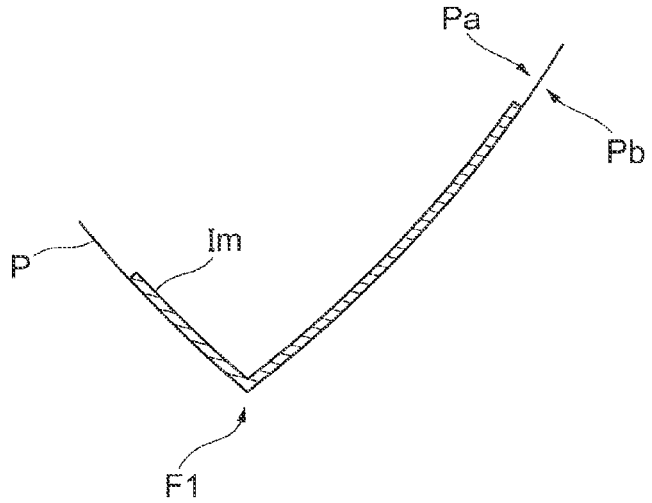
Figure 15C:
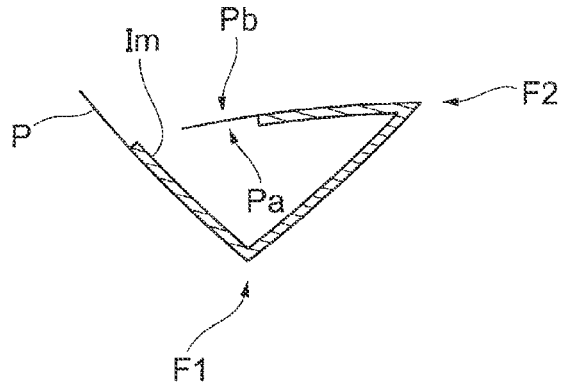

FIGS. 15A to 15C are diagrams illustrating a relationship between the paper P subjected to folding and curl of the paper P in the inner image C-folding mode.

As illustrated in FIG. 12, the image output mode of the image forming apparatus 1 is set to "reversed output mode", and the decurler 3*a* in the transport unit 3 is set to "change a curl direction (convex downward)" in the inner image C-folding mode. Thus, the paper P at the intake thereof is such that the upper side Ts of the paper P corresponds to the front side Pa (where the image Im is formed) and that the lower side Us of the paper P corresponds to the rear side Pb (where the image Im is not formed) in accordance with "reversed output mode" as illustrated in FIG. 15A (refer to FIG. 11B as well). The paper P at the intake thereof is "convex downward", that is, the front side Pa (where the image Im is formed) corresponding to the upper side Ts being concave and the rear side Pb (where the image Im is not formed) corresponding to the lower side Us being convex, in accordance with the setting "change a curl direction" for the decurler 3*a* as illustrated in FIG. 15A.

The difference from the envelope Z-folding mode is that the front side Pa of the paper P at the intake thereof corresponds to the upper side Ts in the inner image C-folding mode, while the front side Pa of the paper P at the intake thereof corresponds to the lower side Us in the envelope Z-folding mode (refer to FIGS. 13A to 13C). The difference from the envelope Z-folding mode is that curl of the paper P at the intake thereof is "convex downward" in the inner image C-folding mode, while curl of the paper P at the intake thereof is "convex upward" in the envelope Z-folding mode.

The difference from the outer image C-folding mode is that the front side Pa of the paper P at the intake thereof corresponds to the upper side Ts in the inner image C-folding mode, while the front side Pa of the paper P at the intake thereof corresponds to the lower side Us in the outer image C-folding mode (refer to FIGS. 14A to 14C). What is common to the inner image C-folding mode and the outer image C-folding mode is that curl of the paper P at the intake thereof is "convex downward".

Next, the paper P enters the first nip position A in such a manner that the convex rear side Pb comes in contact with the first folding roll 41C provided in the first folding mechanism 41. As a result, the first fold F1 that looks like a mountain fold when seen from the rear side Pb side of the paper P (a valley fold when seen from the front side Pa side of the paper P) is formed in a part of the paper P passing through the first nip position A on the trailing edge side of the paper P from the center as illustrated in FIG. 15B. At this point, since the image Im is formed on the front side Pa of the paper P, the image Im is positioned on the inner side of the folded paper P after the first fold F1 is formed in the paper P.

Then, the paper P in which the first fold F1 is formed enters the second nip position B in such a manner that the convex rear side Pb comes in contact with the second folding roll 42C provided in the second folding mechanism 42. As a result, the second fold F2 that looks like a mountain fold when seen from the rear side Pb side of the paper P (a valley fold when seen from the front side Pa side of the paper P) is formed in a part of the paper P passing through the second nip position B on the leading edge side of the paper P from the center as illustrated in FIG. 15C. At this point, since the image Im is formed on the front side Pa of the paper P, the image Im is positioned on the inner side (valley fold side) of the paper P folded at two places after the second fold F2 is formed in the paper P.

Z-Folding Mode

Figure 16A:
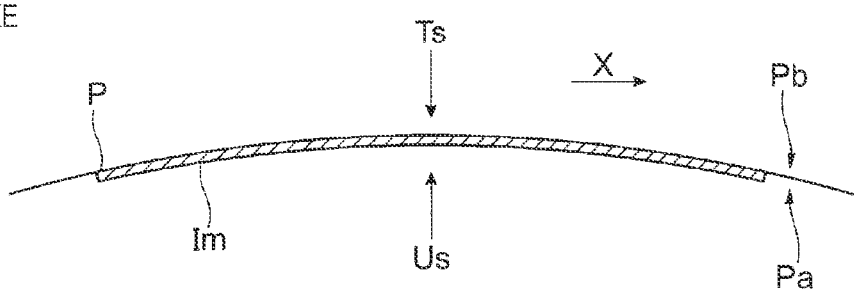
FIGS. 16A, 16B and 16C are diagrams illustrating a relationship between a paper subjected to folding and curl of the paper in a Z-folding mode.
Figure 16B:
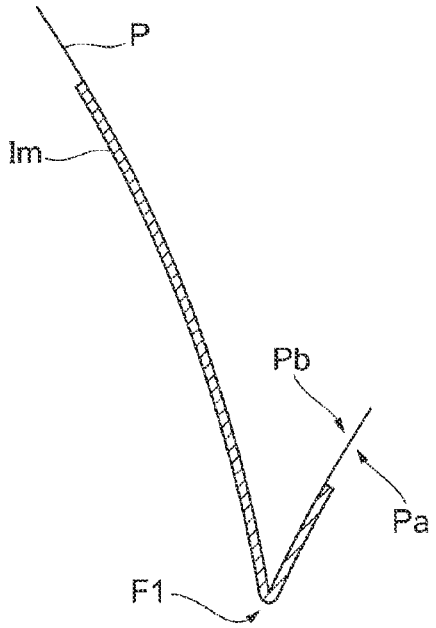
Figure 16C:
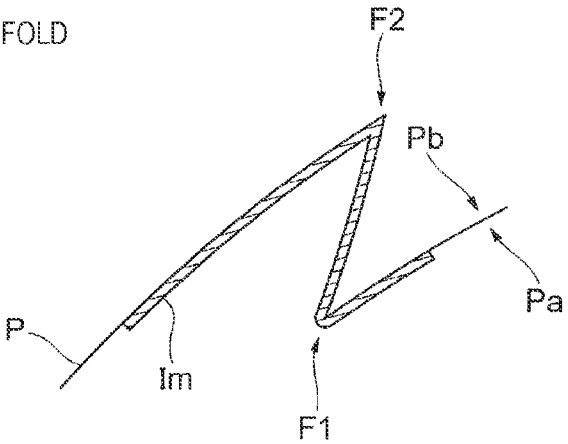

FIGS. 16A to 16C are diagrams illustrating a relationship between the paper P subjected to folding and curl of the paper P in the Z-folding mode.

As illustrated in FIG. 12, the image output mode of the image forming apparatus 1 is set to "regular output mode", and the decurler 3*a* in the transport unit 3 is set to "maintain a curl direction (convex upward)" in the Z-folding mode. Thus, the paper P at the intake thereof is such that the upper side Ts of the paper P corresponds to the rear side Pb (where the image Im is not formed) and that the lower side Us of the paper P corresponds to the front side Pa (where the image Im is formed) in accordance with "regular output mode" as illustrated in FIG. 16A (refer to FIG. 11A as well). The paper P at the intake thereof is "convex upward", that is, the rear side Pb (where the image Im is not formed) corresponding to the upper side Ts being convex and the front side Pa (where the image Im is formed) corresponding to the lower side Us being concave, in accordance with the setting "maintain a curl direction" for the decurler 3*a* as illustrated in FIG. 16A.

What is common to the Z-folding mode and the envelope Z-folding mode (refer to FIGS. 13A to 13C) is that the front side Pa of the paper P at the intake thereof corresponds to the lower side Us. What is common to the Z-folding mode and the envelope Z-folding mode is that curl of the paper P at the intake thereof is "convex upward".

What is common to the Z-folding mode and the outer image C-folding mode (refer to FIGS. 14A to 14C) is that the front side Pa of the paper P at the intake thereof corresponds to the lower side Us. The difference from the outer image C-folding mode is that curl of the paper P at the intake thereof is "convex upward" in the Z-folding mode, while curl of the paper P at the intake thereof is "convex downward" in the outer image C-folding mode.

The difference from the inner image C-folding mode is that the front side Pa of the paper P at the intake thereof corresponds to the lower side Us in the Z-folding mode, while the front side Pa of the paper P at the intake thereof corresponds to the upper side Ts in the inner image C-folding mode (refer to FIGS. 15A to 15C). The difference from the inner image C-folding mode is that curl of the paper P at the intake thereof is "convex upward" in the Z-folding mode, while curl of the paper P at the intake thereof is "convex downward" in the inner image C-folding mode.

Next, the paper P enters the first nip position A in such a manner that the concave front side Pa comes in contact with the first folding roll 41C provided in the first folding mechanism 41. As a result, the first fold F1 that looks like a mountain fold when seen from the front side Pa side of the paper P (a valley fold when seen from the rear side Pb side of the paper P) is formed in a part of the paper P passing through the first nip position A on the leading edge side of the paper P from the center as illustrated in FIG. 16B. At this point, since the image Im is formed on the front side Pa of the paper P, the image Im is positioned on the outer side of the folded paper P after the first fold F1 is formed in the paper P.

Then, the paper P in which the first fold F1 is formed enters the second nip position B in such a manner that the convex rear side Pb comes in contact with the second folding roll 42C provided in the second folding mechanism 42. As a result, the second fold F2 that looks like a mountain fold when seen from the rear side Pb side of the paper P (a valley fold when seen from the front side Pa side of the paper P) is formed in a central part of the paper P passing through the second nip position B as illustrated in FIG. 16C. At this point, since the image Im is formed on the front side Pa of the paper P, the image Im is positioned on the outer side (around the first fold F1) of the paper P folded at two places and on the inner side (around the second fold F2) of the valley-folded paper P after the second fold F2 is formed in the paper P.

Relationship Between Curl of Paper and Paper after Envelope C-Folding

The reason why the curl direction of the paper P is changed from "convex upward" to "convex downward" before the envelope C-folding (the outer image C-folding and the inner image C-folding) is performed of the paper P in the present exemplary embodiment will be described.

Figure 17A:
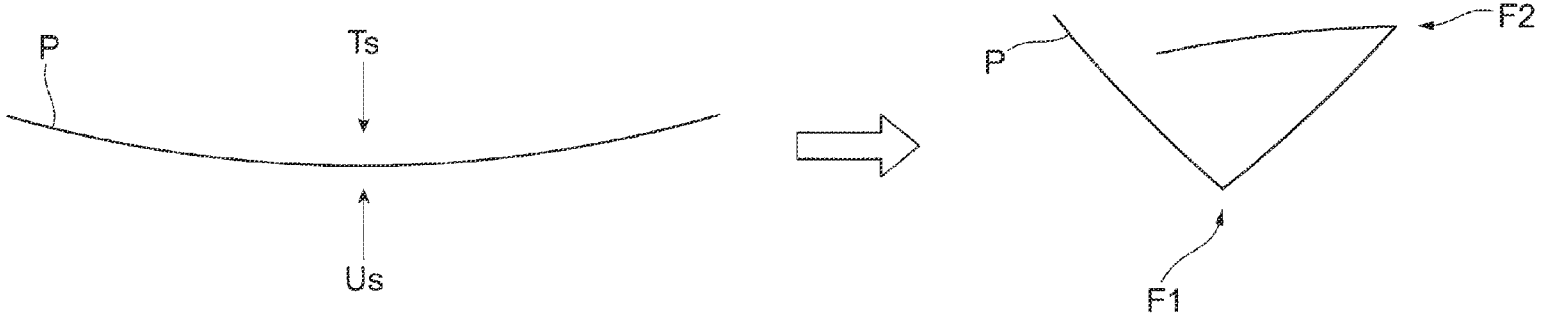
FIGS. 17A and 17B are diagrams illustrating a relationship between curl of a paper and the paper after subjected to envelope C-folding.
Figure 17B:
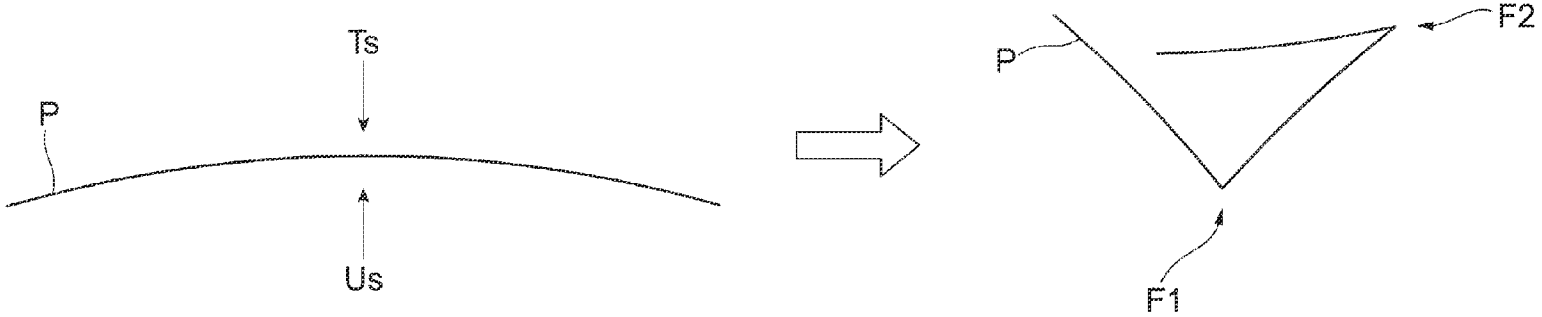

FIGS. 17A and 17B are diagrams illustrating a relationship between curl of the paper P and the paper P after the envelope C-folding. FIG. 17A illustrates performing the envelope C-folding of the paper P that exhibits a shape of curl "convex downward" when brought into the folding unit 4 (at the intake thereof to the intake roller 43), and FIG. 17B illustrates performing the envelope C-folding of the paper P that exhibits a shape of curl "convex upward" when brought into the folding unit 4.

First, as illustrated in FIG. 17A, when the folding functional unit 4*a* performs the envelope C-folding of the paper P of which the lower side Us is convex when brought in, a first fold F1 side end portion (trailing edge side) of the paper P that is positioned on the inner side of the paper P from a second fold F2 side end portion (leading edge side) of the paper P is curled in a direction approaching the second fold F2 after the envelope C-folding. Therefore, a folding defect called a dog ear is unlikely to arise in the first fold F1 side end portion in a case where such a configuration is employed in forming the first fold F1 and the second fold F2 in the paper P using the folding functional unit 4*a*. A jam of the paper P is also unlikely to arise by employing such a configuration in a case of forming the first fold F1 and the second fold F2 in the paper P using the folding functional unit 4*a*.

Meanwhile, as illustrated in FIG. 17B, when the folding functional unit 4*a* performs the envelope C-folding of the paper P of which the lower side Us is concave when brought in, the first fold F1 side end portion of the paper P that is positioned on the inner side of the paper P from the second fold F2 side end portion of the paper P is curled in a direction receding from the second fold F2 after the envelope C-folding. Therefore, a folding defect called a dog ear is likely to arise in the first fold F1 side end portion in a case where such a configuration is employed in forming the first fold F1 and the second fold F2 in the paper P using the folding functional unit 4*a*. A jam of the paper P is also likely to arise by employing such a configuration in a case of forming the first fold F1 and the second fold F2 in the paper P using the folding functional unit 4*a*.

Thus, the present exemplary embodiment employs the technique illustrated in FIG. 17A when the envelope C-folding is performed of the paper P.

Others

While the decurler 3*a* is provided in the transport unit 3 in the present exemplary embodiment, the present invention is not limited thereto.

The decurler 3*a* may be incorporated in the folding unit 4.

While the paper P of which the curl is "convex upward" is subjected to rectification to render the curl "convex downward" using the decurler 3*a* and is then subjected to the envelope C-folding in the present exemplary embodiment, the present invention is not limited thereto. For example, the paper P that is not curled may be subjected to rectification to have a curl "convex downward" by using the decurler 3*a* and then may be subjected to the envelope C-folding. For example, the paper P of which the curl is previously "convex downward" may be subjected to rectification to render the curl further "convex downward" using the decurler 3*a* and then may be subjected to the envelope C-folding.

While the paper P of which the curl is "convex upward" is subjected to the envelope Z-folding or the Z-folding without being subjected to rectification of the curl by the decurler 3*a* in the present exemplary embodiment, the present invention is not limited thereto. For example, the paper P of which the curl is "convex upward" may be subjected to rectification to render the curl "convex downward" using the decurler 3*a* and then may be subjected to the envelope Z-folding or the Z-folding.

Second Exemplary Embodiment

The curl direction of the paper P is changed by using the decurler 3*a* in the first exemplary embodiment.

Meanwhile, the present exemplary embodiment changes the curl direction of the paper P using an inverter 3*b* (refer to FIG. 18 described later) that reverses the paper P inside out. The same part as the first exemplary embodiment will be designated by the same reference sign and will not be described in detail in the present exemplary embodiment.

Configuration of Image Forming System

Figure 18:
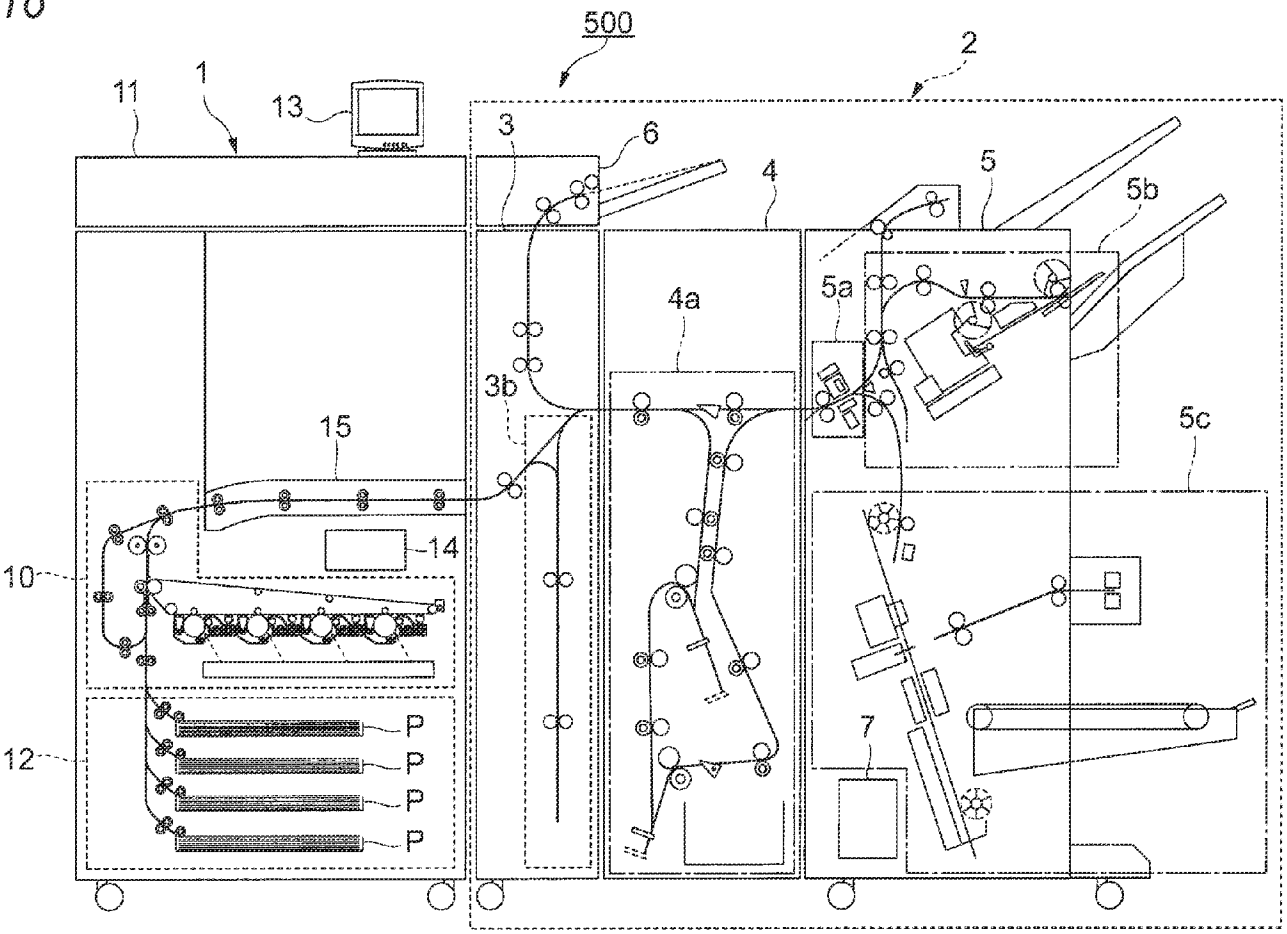
FIG. 18 is a diagram illustrating an overall configuration of an image forming system to which a second exemplary embodiment is applied.

FIG. 18 is a diagram illustrating an overall configuration of the image forming system 500 to which the present exemplary embodiment is applied.

The difference from the first exemplary embodiment is that the inverter 3*b* instead of the decurler 3*a* is provided in the transport unit 3 in the image forming system 500. The inverter 3*b*, one example of the output unit, the adjusting unit, and the reversing unit, reverses the transport direction of the paper P brought in from the image forming apparatus 1 to reverse the paper P inside out and transports the paper P to the folding unit 4.

Relationship Between Folding Mode, Image Output Mode, and Setting for Decurler

In the image forming system 500 of the present exemplary embodiment, the image output mode in the image forming apparatus 1 and a setting for the inverter 3*b* in the transport unit 3 are configured to be switched according to the folding mode set in the image forming system 500 on the basis of a job specification received through the user interface unit 13.

FIG. 19 is a diagram illustrating a relationship among the folding mode, the image output mode, and the setting for the inverter 3*b* in the present exemplary embodiment.

First, the image output mode of the image forming apparatus 1 is set to "regular output mode", and the inverter 3*b* in the transport unit 3 is set to be "not used" in a case where "folding is not performed" of the paper P by the folding unit 4 (folding mode: no).

The image output mode of the image forming apparatus 1 is set to "regular output mode", and the inverter 3*b* in the transport unit 3 is set to be "not used" in a case where "envelope Z-folding" is performed of the paper P by the folding unit 4 (folding mode: envelope Z-folding).

The image output mode of the image forming apparatus 1 is set to "reversed output mode", and the inverter 3*b* in the transport unit 3 is set to be "used" in a case where "outer image C-folding" is performed of the paper P by the folding unit 4 (folding mode: outer image C-folding (envelope C-folding)).

The image output mode of the image forming apparatus 1 is set to "regular output mode", and the inverter 3*b* in the transport unit 3 is set to be "used" in a case where "inner image C-folding" is performed of the paper P by the folding unit 4 (folding mode: inner image C-folding (envelope C-folding)).

The image output mode of the image forming apparatus 1 is set to "regular output mode", and the inverter 3*b* in the transport unit 3 is set to be "not used" in a case where "Z-folding" is performed of the paper P by the folding unit 4 (folding mode: Z-folding).

The present exemplary embodiment is different from the first exemplary embodiment in that the image output mode is set to "reversed output" in a case where the folding mode is "outer image C-folding" (refer to FIG. 12). The present exemplary embodiment is different from the first exemplary embodiment in that the image output mode is set to "regular output" in a case where the folding mode is "inner image C-folding" (refer to FIG. 12).

Relationship Between Folding Mode and Curl of Paper

A relationship between the folding mode and curl of the paper P in the image forming system 500 of the present exemplary embodiment will be described. Four folding modes (the envelope Z-folding mode, an outer image C-folding mode (the envelope C-folding), an inner image C-folding mode (the envelope C-folding), and the Z-folding mode) may be selectively performed in the image forming system 500 of the present exemplary embodiment in the same manner as the first exemplary embodiment.

Hereinafter, the folding modes will be described in order.

Envelope Z-Folding Mode

As illustrated in FIG. 19, the image output mode of the image forming apparatus 1 is set to "regular output mode", and the inverter 3*b* in the transport unit 3 is set to be "not used" in the envelope Z-folding mode.

Thus, the paper P at the intake thereof to the folding unit 4 is such that the upper side Ts of the paper P corresponds to the rear side Pb (where the image Im is not formed) and that the lower side Us of the paper P corresponds to the front side Pa (where the image Im is formed) in accordance with "regular output mode" and the setting "not used" for the inverter 3*b* (refer to FIG. 11A as well). The paper P at the intake thereof is "convex upward", that is, the rear side Pb (where the image Im is not formed) corresponding to the upper side Ts being convex and the front side Pa (where the image Im is formed) corresponding to the lower side Us being concave, in accordance with the setting "not used" for the inverter 3*b*.

The state of the paper P at the intake thereof is the same as that of the first exemplary embodiment in the envelope Z-folding mode (refer to FIG. 13A). Therefore, in the envelope Z-folding mode, the first fold F1 illustrated in FIG. 13B is formed in the paper P illustrated in FIG. 13A, and then the second fold F2 illustrated in FIG. 13C is formed in the paper P in the same manner as the first exemplary embodiment.

Outer Image C-Folding Mode

As illustrated in FIG. 19, the image output mode of the image forming apparatus 1 is set to "reversed output mode", and the inverter 3*b* in the transport unit 3 is set to be "used" in the outer image C-folding mode.

Thus, the paper P at the intake thereof to the folding unit 4 is such that the upper side Ts of the paper P corresponds to the rear side Pb (where the image Im is not formed) and that the lower side Us of the paper P corresponds to the front side Pa (where the image Im is formed) in accordance with "reversed output mode" and the setting "used" for the inverter 3*b* (refer to FIG. 11A as well). The paper P at the intake thereof is "convex downward", that is, the rear side Pb (where the image Im is not formed) corresponding to the upper side Ts being concave and the front side Pa (where the image Im is formed) corresponding to the lower side Us being convex, in accordance with the setting "used" for the inverter 3*b*.

The state of the paper P at the intake thereof is the same as that of the first exemplary embodiment in the outer image C-folding mode as well (refer to FIG. 14A). Therefore, in the outer image C-folding mode, the first fold F1 illustrated in FIG. 14B is formed in the paper P illustrated in FIG. 14A, and then the second fold F2 illustrated in FIG. 14C is formed in the paper P in the same manner as the first exemplary embodiment.

Inner Image C-Folding Mode

As illustrated in FIG. 19, the image output mode of the image forming apparatus 1 is set to "regular output mode", and the inverter 3*b* in the transport unit 3 is set to be "used" in the inner image C-folding mode. Thus, the paper P at the intake thereof to the folding unit 4 is such that the upper side Ts of the paper P corresponds to the front side Pa (where the image Im is formed) and that the lower side Us of the paper P corresponds to the rear side Pb (where the image Im is not formed) in accordance with "regular output mode" and the setting "used" for the inverter 3*b* (refer to FIG. 11B as well). The paper P at the intake thereof is "convex downward", that is, the front side Pa (where the image Im is formed) corresponding to the upper side Ts being concave and the rear side Pb (where the image Im is not formed) corresponding to the lower side Us being convex, in accordance with the setting "used" for the inverter 3*b*.

The state of the paper P at the intake thereof is the same as that of the first exemplary embodiment in the inner image C-folding mode as well (refer to FIG. 15A). Therefore, in the inner image C-folding mode, the first fold F1 illustrated in FIG. 15B is formed in the paper P illustrated in FIG. 15A, and then the second fold F2 illustrated in FIG. 15C is formed in the paper P in the same manner as the first exemplary embodiment.

Z-Folding Mode

As illustrated in FIG. 19, the image output mode of the image forming apparatus 1 is set to "regular output mode", and the inverter 3*b* in the transport unit 3 is set to be "not used" in the Z-folding mode.

Thus, the paper P at the intake thereof to the folding unit 4 is such that the upper side Ts of the paper P corresponds to the rear side Pb (where the image Im is not formed) and that the lower side Us of the paper P corresponds to the front side Pa (where the image Im is formed) in accordance with "regular output mode" and the setting "not used" for the inverter 3*b* (refer to FIG. 11A as well). The paper P at the intake thereof is "convex upward", that is, the rear side Pb (where the image Im is not formed) corresponding to the upper side Ts being convex and the front side Pa (where the image Im is formed) corresponding to the lower side Us being concave, in accordance with the setting "not used" for the inverter 3*b*.

The state of the paper P at the intake thereof is the same as that of the first exemplary embodiment in the Z-folding mode as well (refer to FIG. 16A). Therefore, in the Z-folding mode, the first fold F1 illustrated in FIG. 16B is formed in the paper P illustrated in FIG. 16A, and then the second fold F2 illustrated in FIG. 16C is formed in the paper P in the same manner as the first exemplary embodiment.

[Others]

While the paper P is reversed inside out by reversing the transport direction of the paper P in the present exemplary embodiment, the present invention is not limited thereto. For example, a technique that reverses the paper P inside out, without reversing the transport direction of the paper P, by rotating the paper P around the transport direction of the paper P as an axis may be used.

While the paper P of which the curl is "convex upward" is subjected to the envelope Z-folding or the Z-folding without being subjected to changing the curl by the inverter 3*b* (without being reversed inside out) in the present exemplary embodiment, the present invention is not limited thereto. For example, the paper P of which the curl is "convex upward" may be subjected to changing to render the curl "convex downward" using the inverter 3*b* and then may be subjected to the envelope Z-folding or the Z-folding. In this case, the image output mode at this point in time is required to be the reversed output mode, not the regular output mode.

[Relationship Between Folding Mode and State of Paper in First and Second Exemplary Embodiments]

A relationship between the folding mode and the state of the paper P in the first and second exemplary embodiments will be described.

FIG. 20 is a diagram illustrating a relationship between the folding mode and the state of the paper P in the first exemplary embodiment. FIG. 21 is a diagram illustrating a relationship between the folding mode and the state of the paper P in the second exemplary embodiment. More specifically, FIG. 20 and FIG. 21 illustrate a relationship between the folding mode set in the image forming system 500 and the state of the paper P in each unit constituting the image forming system 500 in each folding mode. FIG. 20 and FIG. 21 do not describe a case where the folding mode is not set (in a case of "no").

Description will be provided of, in association with each folding mode, the side of the paper P on which the image Im is formed by the image forming apparatus 1 (referred to as "image formed side"), the state of the paper P when brought from the image forming apparatus 1 into the transport unit 3 (referred to as "when brought into the transport unit"), the state of the paper P when brought from the transport unit 3 into the folding unit 4 (referred to as "when brought into the folding unit"), the state of the paper P after the first folding by the first folding mechanism 41 (referred to as "first folding"), and the state of the paper P after the second folding by the second folding mechanism 42 (referred to as "second folding"). The state of the paper P "when brought into the transport unit" includes "lower side" and "convex side" of the paper P. The state of the paper P "when brought into the folding unit" includes "lower side" and "convex side" of the paper P. The state of the paper P in "first folding" includes the side on which the first fold F1 is formed to be a mountain fold (referred to as "first fold formed side (mountain fold)") and the position in which the first fold F1 is formed with respect to the second fold F2 (referred to as "first fold formed position") when the transport direction of the paper P when brought into the folding unit 4 is used as a reference. The state of the paper P in "second folding" includes the side on which the second fold F2 is formed to be a mountain fold (referred to as "second fold formed side (mountain fold)") and the position in which the second fold F2 is formed with respect to the first fold F1 (referred to as "second fold formed position") when the transport direction of the paper P when brought into the folding unit 4 is used as a reference.

A "side" of the paper P is represented by "front side Pa" or "rear side Pb", and "fold formed position" in the paper P is represented by "leading edge side" or "trailing edge side". The "leading edge side" of the paper P illustrated in FIG. 20 and FIG. 21 refers to the leading edge side, in the transport direction, of the paper P that is brought from the transport unit 3 into the folding unit 4 (the paper P that passes through the intake roller 43 provided on the straight transport path R1). The "trailing edge side" of the paper P illustrated in FIG. 20 and FIG. 21 refers to the trailing edge side, in the transport direction, of the paper P that is brought from the transport unit 3 into the folding unit 4 (the paper P that passes through the intake roller 43). Therefore, the leading edge side of the paper P may have the transport direction reversed (may be changed to the trailing edge side) on the detour transport path R2.

[Relationship in First Exemplary Embodiment]

First, a relationship between the folding mode and the state of the paper P in the first exemplary embodiment will be described with reference to FIG. 20.

The image formed side is "front side Pa" in the envelope Z-folding mode. The lower side of the paper P when brought into the transport unit is "front side Pa", and the convex side thereof is "rear side Pb". The lower side of the paper P when brought into the folding unit is "front side Pa", and the convex side thereof is "rear side Pb". The first fold formed side in the first folding is "front side Pa", and the first fold formed position is "leading edge side". The second fold formed side in the second folding is "rear side Pb", and the second fold formed position is "trailing edge side".

The image formed side is "front side Pa" in the outer image C-folding mode. The lower side of the paper P when brought into the transport unit is "front side Pa", and the convex side thereof is "rear side Pb". The lower side of the paper P when brought into the folding unit is "front side Pa", and the convex side thereof is "front side Pa". The first fold formed side in the first folding is "front side Pa", and the first fold formed position is "trailing edge side". The second fold formed side in the second folding is "front side Pa", and the second fold formed position is "leading edge side".

The image formed side is "front side Pa" in the inner image C-folding mode. The lower side of the paper P when brought into the transport unit is "rear side Pb", and the convex side thereof is "front side Pa". The lower side of the paper P when brought into the folding unit is "rear side Pb", and the convex side thereof is "rear side Pb". The first fold formed side in the first folding is "rear side Pb", and the first fold formed position is "trailing edge side". The second fold formed side in the second folding is "rear side Pb", and the second fold formed position is "leading edge side".

The image formed side is "front side Pa" in the Z-folding mode. The lower side of the paper P when brought into the transport unit is "front side Pa", and the convex side thereof is "front side Pa". The lower side of the paper P when brought into the folding unit is "front side Pa", and the convex side thereof is "rear side Pb". The first fold formed side in the first folding is "front side. Pa", and the first fold formed position is "leading edge side". The second fold formed side in the second folding is "rear side Pb", and the second fold formed position is "trailing edge side".

[Relationship in Second Exemplary Embodiment]

Next, a relationship between the folding mode and the state of the paper in the second exemplary embodiment will be described with reference to FIG. 21.

The image formed side is "front side Pa" in the envelope Z-folding mode. The lower side of the paper P when brought into the transport unit is "front side Pa", and the convex side thereof is "rear side Pb". The lower side of the paper P when brought into the folding unit is "front side Pa", and the convex side thereof is "rear side Pb". The first fold formed side in the first folding is "front side Pa", and the first fold formed position is "leading edge side". The second fold formed side in the second folding is "rear side Pb", and the second fold formed position is "trailing edge side".

The image formed side is "front side Pa" in the outer image C-folding mode. The lower side of the paper P when brought into the transport unit is "rear side Pb", and the convex side thereof is "front side Pa". The lower side of the paper P when brought into the folding unit is "front side Pa", and the convex side thereof is "front side Pa". The first fold formed side in the first folding is "front side Pa", and the first fold formed position is "trailing edge side". The second fold formed side in the second folding is "front side Pa", and the second fold formed position is "leading edge side".

The image formed side is "front side Pa" in the inner image C-folding mode. The lower side of the paper P when brought into the transport unit is "front side Pa", and the convex side thereof is "rear side Pb". The lower side of the paper P when brought into the folding unit is "rear side Pb", and the convex side thereof is "rear side Pb". The first fold formed side in the first folding is "rear side Pb", and the first fold formed position is "trailing edge side". The second fold formed side in the second folding is "rear side Pb", and the second fold formed position is "leading edge side".

The image formed side is "front side Pa" in the Z-folding mode. The lower side of the paper P when brought into the transport unit is "front side Pa", and the convex side thereof is "rear side Pb". The lower side of the paper P when brought into the folding unit is "front side Pa", and the convex side thereof is "rear side Pb". The first fold formed side in the first folding is "front side Pa", and the first fold formed position is "leading edge side". The second fold formed side in the second folding is "rear side Pb", and the second fold formed position is "trailing edge side".

[Comparison Between First Exemplary Embodiment and Second Exemplary Embodiment]

Next, the first exemplary embodiment and the second exemplary embodiment will be compared with each other with reference to FIG. 20 and FIG. 21.

First, the state of the paper P in each unit in the envelope Z-folding mode is common to the first exemplary embodiment and the second exemplary embodiment. The state of the paper P in each unit in the Z-folding mode is also common to the first exemplary embodiment and the second exemplary embodiment.

The state of the paper P in each unit in the outer image C-folding mode is common to the first exemplary embodiment and the second exemplary embodiment except for when brought into the transport unit. The state of the paper P in each unit in the inner image C-folding mode is common to the first exemplary embodiment and the second exemplary embodiment except for when brought into the transport unit.

The reason why the state of the paper P in the outer image C-folding mode and in the inner image C-folding mode is different between the first exemplary embodiment and the second exemplary embodiment is described as follows. First, in the outer image C-folding mode and in the inner image C-folding mode of the first exemplary embodiment, the decurler 3*a* provided in the transport unit 3 is used to change the curl direction of the paper P without reversing the paper P inside out. Meanwhile, in the outer image C-folding mode and in the inner image C-folding mode of the second exemplary embodiment, the inverter 3*b* provided in the transport unit 3 is used to change the curl direction of the paper P by reversing the paper P inside out. Thus, the image forming apparatus 1 of the first exemplary embodiment, for an outer image tri-folding mode that requires changing the curl direction, supplies the paper P to the transport unit 3 in the regular output mode and, for an inner image tri-folding mode that also requires changing the curl direction, supplies the paper P to the transport unit 3 in the reversed output mode. Meanwhile, the image forming apparatus 1 of the second exemplary embodiment, for the outer image tri-folding mode that requires changing the curl direction, supplies the paper P to the transport unit 3 in the reversed output mode which is opposite to that of the first exemplary embodiment and, for the inner image tri-folding mode that also requires changing the curl direction, supplies the paper P to the transport unit 3 in the regular output mode which is opposite to that of the first exemplary embodiment.

The foregoing description of the embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A sheet processing apparatus comprising:

an output unit configured to render one side of a sheet convex and outputs the sheet, the sheet having one side and an other side;

a first folding unit configured to mountain-fold the one side of the sheet, which is rendered to be convex, to form a first fold in the sheet;

a second folding unit configured to mountain-fold the one side of the sheet, which includes the first fold formed therein, to form a second fold in the sheet; and a reversing unit configured to reverse a direction of curvature of the sheet supplied to the first folding unit between a first direction of curvature in a case where inner tri-folding is performed of the sheet and a second direction of curvature in a case where outer tri-folding is performed of the sheet, the inner tri-folding and the outer tri-folding are performed using the first folding unit and the second folding unit.

2. The sheet processing apparatus according to claim 1, wherein the first folding unit mountain-folds the one side of the sheet, which is rendered to be convex, to form the first fold in the sheet, and the second folding unit mountain-folds the other side of the sheet, which includes the first fold formed therein, to form a second fold in the sheet.

3. A sheet processing apparatus comprising:

an output unit configured to render one side of a sheet convex and outputs the sheet, the sheet having one side and an other side;

a first folding unit configured to mountain-fold the one side of the sheet, which is rendered to be convex, to form a first fold;

a second folding unit configured to selectively perform inner tri-folding that mountain-folds the one side of the sheet, which includes the first fold formed therein, to form a second fold, or outer tri-folding that mountain-folds the other side of the sheet, which includes the first fold formed therein, to form a second fold; and a reversing unit configured to reverse a direction of curvature of the sheet supplied to the first folding unit between a first direction of curvature in a case where inner tri-folding is performed of the sheet and a second direction of curvature in a case where outer tri-folding is performed of the sheet, the inner tri-folding and the outer tri-folding are performed using the first folding unit and the second folding unit.

4. The sheet processing apparatus according to claim 3, wherein the second folding unit forms the second fold on a leading edge side, in a transport direction of the sheet passing through the output unit, of the sheet from the first fold in the inner tri-folding and forms the second fold on a trailing edge side, in the transport direction, of the sheet from the first fold in the outer tri-folding.

* * * * *